US012448014B2

(12) United States Patent
Woods

(10) Patent No.: US 12,448,014 B2
(45) Date of Patent: Oct. 21, 2025

(54) RAILROAD CAR TRUCK SIDE FRAME

(71) Applicant: Transportation IP Holdings, LLC, Norwalk, CT (US)

(72) Inventor: Benjamin T. Woods, Lockport, IL (US)

(73) Assignee: Transportation IP Holdings, LLC, Norwalk, CT (US)

( * ) Notice: Subject to any disclaimer, the term of this patent is extended or adjusted under 35 U.S.C. 154(b) by 630 days.

(21) Appl. No.: 17/931,347

(22) Filed: Sep. 12, 2022

(65) Prior Publication Data

US 2023/0001963 A1 Jan. 5, 2023

Related U.S. Application Data

(63) Continuation of application No. 16/378,932, filed on Apr. 9, 2019, now Pat. No. 11,479,276.

(60) Provisional application No. 62/675,951, filed on May 24, 2018.

(51) Int. Cl.
*B61F 5/52* (2006.01)
*B61F 5/30* (2006.01)

(52) U.S. Cl.
CPC ..... *B61F 5/52* (2013.01); *B61F 5/301* (2013.01)

(58) Field of Classification Search
CPC ..... B61F 5/06; B61F 5/301; B61F 5/52
See application file for complete search history.

(56) References Cited

U.S. PATENT DOCUMENTS 239,510 A * 3/1881 Kellog et al. ..... B61F 5/52 105/208
1,351,326 A * 8/1920 Claus ..... B61F 5/52 105/205
1,652,002 A * 12/1927 Doerr ..... B61F 5/52 105/205
1,718,470 A * 6/1929 Martin ..... B61F 5/52 105/205
1,735,830 A * 11/1929 Lewis ..... B61F 5/06 105/197.05
1,745,673 A * 2/1930 Hankins ..... B61F 5/52 105/205
1,760,181 A * 5/1930 Stertzbach ..... B61F 5/52 105/206.1

(Continued)

FOREIGN PATENT DOCUMENTS

EP 3121088 A1 * 1/2017 ..... B61F 3/02
WO WO-2008013480 A1 * 1/2008 ..... B61F 5/52

(Continued)

OTHER PUBLICATIONS

ISA Korean Intellectual Property Office, International Search Report Issued in Application No. PCT/US2019/032135, Aug. 22, 2019, WIPO, 3 pages.

(Continued)

*Primary Examiner* — Paul N Dickson
*Assistant Examiner* — Maxwell L Meshaka
(74) *Attorney, Agent, or Firm* — K&L Gates LLP

(57) ABSTRACT

A railroad car truck including one or two new side frames that each includes one or more of a plurality of different improvements that individually and in various combinations reduce, inhibit, or minimize the likelihood of stress fractures or cracks in the side frame.

20 Claims, 25 Drawing Sheets

(56) References Cited

U.S. PATENT DOCUMENTS 1,760,196 A * 5/1930 Hansen ..... B61F 5/52 105/197.05
RE18,690 E * 12/1932 Clasen ..... B61F 5/52 105/205
1,902,805 A * 3/1933 Dreibuss ..... B61F 5/52 105/205
1,916,053 A * 6/1933 Johnson ..... B61F 5/52 105/205
1,957,833 A * 5/1934 Hamilton ..... B61F 5/52 105/197.05
2,322,599 A * 6/1943 Spenner ..... B61F 5/52 105/205
2,393,046 A * 1/1946 Keller ..... B61F 5/52 105/206.2
2,508,020 A * 5/1950 Flesch ..... B61F 5/52 188/212
2,620,744 A * 12/1952 Gray ..... B61F 5/26 105/206.2
3,837,293 A 9/1974 Neumann et al.
3,880,089 A * 4/1975 Wallace ..... B61F 5/52 105/198.4
4,067,261 A * 1/1978 Scheffel ..... B61F 3/10 105/182.1
RE31,008 E 8/1982 Barber
4,351,242 A * 9/1982 Irwin ..... B61F 5/52 105/206.2
4,363,276 A 12/1982 Neumann
5,027,716 A * 7/1991 Weber ..... B61F 5/06 105/171
5,224,428 A 7/1993 Wronkiewicz
5,305,694 A 4/1994 Wronkiewicz et al.
5,410,968 A * 5/1995 Hawthorne ..... B61F 5/52 105/206.1
5,481,986 A * 1/1996 Spencer ..... B22C 9/02 105/206.1
5,718,177 A 2/1998 Wronkiewicz et al.
5,752,564 A * 5/1998 Callahan ..... B22D 25/02 164/369
5,954,114 A * 9/1999 Bauer ..... B22C 21/14 164/369
5,967,053 A * 10/1999 Toussaint ..... B22C 21/14 105/206.1
6,089,166 A * 7/2000 Callahan ..... B22C 9/02 105/228
6,543,367 B1 4/2003 Stecker et al.
6,622,776 B2 9/2003 Bauer et al.
6,662,853 B2 12/2003 Bauer et al.
7,478,599 B1 1/2009 Lydic et al.
7,681,506 B2 * 3/2010 Forbes ..... B61F 5/52 105/226
8,104,409 B2 1/2012 Wolinski et al.
8,991,318 B2 * 3/2015 Wike ..... B61F 5/52 105/198.4
9,216,450 B2 * 12/2015 Gotlund ..... B22C 9/088
9,434,393 B2 * 9/2016 Gotlund ..... B61F 5/32
9,580,087 B2 * 2/2017 Gotlund ..... B61F 5/52
9,669,846 B2 * 6/2017 Gotlund ..... B61F 5/32
9,758,181 B2 * 9/2017 Gotlund ..... B61F 5/125
10,112,629 B2 * 10/2018 Gotlund ..... B22C 9/088
10,239,118 B2 * 3/2019 Gotlund ..... B22C 9/02
10,421,467 B2 * 9/2019 Gotlund ..... B61F 5/52
10,562,547 B2 * 2/2020 Gotlund ..... B61F 5/305
10,913,469 B2 * 2/2021 Woods ..... B61F 5/38
11,479,276 B2 * 10/2022 Woods ..... B61F 5/06
11,499,862 B2 * 11/2022 Wike ..... B61F 5/06
12,291,247 B2 * 5/2025 Gotlund ..... B61F 5/125
2001/0000571 A1 * 5/2001 Bauer ..... B22C 9/02 105/206.1
2003/0136542 A1 * 7/2003 Bauer ..... B22C 21/14 164/369
2003/0221811 A1 * 12/2003 Smith ..... B22C 9/108 164/369
2004/0020403 A1 2/2004 Forbes
2006/0283351 A1 * 12/2006 Forbes ..... B61F 5/52 105/157.1
2010/0139521 A1 6/2010 Forbes
2010/0199880 A1 8/2010 East et al.
2012/0291661 A1 * 11/2012 Gotlund ..... B22D 25/02 105/206.1
2014/0060380 A1 3/2014 Berg et al.
2014/0245921 A1 9/2014 Forbes et al.
2014/0261064 A1 * 9/2014 Wike ..... B61F 5/52 105/198.4
2015/0183442 A1 * 7/2015 Gotlund ..... B61F 5/305 105/224.05
2015/0183444 A1 * 7/2015 Gotlund ..... B61F 5/52 105/224.1
2015/0183445 A1 * 7/2015 Gotlund ..... B61F 5/50 29/897.2
2015/0183446 A1 * 7/2015 Gotlund ..... B61F 5/26 105/224.1
2016/0001796 A1 * 1/2016 Hematian ..... B61F 5/52 105/206.1
2016/0137211 A1 * 5/2016 Gotlund ..... B22C 9/108 164/6
2017/0327135 A1 * 11/2017 Gotlund ..... B61F 5/305
2018/0029109 A1 * 2/2018 Gotlund ..... B22C 9/082
2018/0162420 A1 * 6/2018 Gotlund ..... B61F 5/52
2019/0185032 A1 * 6/2019 Woods ..... B61F 5/06
2019/0359230 A1 * 11/2019 Woods ..... B61F 5/52
2020/0132537 A1 * 4/2020 Wike ..... B61K 9/02
2023/0001963 A1 * 1/2023 Woods ..... B61F 5/301
2024/0010246 A1 * 1/2024 Gotlund ..... B61F 5/14
2024/0294195 A1 * 9/2024 Woods ..... B61F 5/122
2025/0145187 A1 * 5/2025 Woods ..... B61F 5/52

FOREIGN PATENT DOCUMENTS

WO 2008070953 A1 6/2008
WO WO-2019154439 A1 * 8/2019 ..... B61F 5/14
WO WO-2022077077 A1 * 4/2022
WO WO-2022116590 A1 * 6/2022 ..... B61C 9/50

OTHER PUBLICATIONS

International Bureau of WIPO, International Preliminary Report on Patentability Issued in Application No. PCT/US2019/032135, Dec. 3, 2020, WIPO, 9 pages.

* cited by examiner

RAILROAD CAR TRUCK SIDE FRAME

CROSS-REFERENCE TO RELATED APPLICATIONS

The present application is a continuation of U.S. patent application Ser. No. 16/378,932, entitled "RAILROAD CAR TRUCK SIDE FRAME", and filed on Apr. 9, 2019. U.S. patent application Ser. No. 16/378,932 claims priority to U.S. Provisional Application No. 62/675,951, entitled "RAILROAD CAR TRUCK SIDE FRAME", and filed on May 24, 2018. The entire contents of each of the above mentioned applications are hereby incorporated by reference for all purposes.

BACKGROUND

Conventional freight railroad cars in North America and other parts of the world typically include a car body and two spaced apart trucks. The car body or car body under frame typically includes two spaced apart center plates that respectively rest on and are rotatably received by bolster bowls of the two trucks. The trucks rollingly support the car body along railroad tracks or rails. Each truck generally has a three piece truck configuration that includes two spaced apart parallel side frames and a bolster. The side frames generally extend in the same direction as the tracks or rails, and the bolster generally extends transversely or laterally to the tracks or rails. The bolster extends laterally through and between and is supported by the two spaced apart side frames. Each side frame typically defines a center opening and pedestal jaw openings on each side of the center opening. Each end of each bolster is typically supported by a spring group positioned in the center opening of the side frame and supported by the lower portion of the side frame that defines the center opening.

Each truck also typically includes two axles that support the side frames, four wheels, and four roller bearing assemblies respectively mounted on the ends of the axles. The truck further typically includes four bearing adapters respectively positioned on each roller bearing assembly in the respective pedestal jaw opening below the downwardly facing wall of the side frame that defines the top of the pedestal jaw opening. The wheel sets of the truck are thus received in bearing adapters placed in leading and trailing pedestal jaws in the side frames, so that axles of the wheel sets are generally parallel. The bearing adapters permit relatively slight angular displacement of the axles. The spring sets or groups permit the bolster to move somewhat with respect to each side frame, about longitudinal or horizontal, vertical, and transverse axes (and combinations thereof).

Directions and orientations herein refer to the normal orientation of a railroad car in use. Thus, unless the context clearly requires otherwise, the "longitudinal" axis or direction is substantially parallel to straight tracks or rails and in the direction of movement of the railroad car on the track or rails in either direction. The "transverse" or "lateral" axis or direction is in a horizontal direction substantially perpendicular to the longitudinal axis and the straight tracks or rails. "Vertical" is the up-and-down direction, and "horizontal" is a plane parallel to the tracks or rails including the transverse and longitudinal axes. The "front" or "leading" side of the truck means the first side of a truck of a railroad car to encounter a turn; and the "rear" or "trailing" side is opposite the leading side.

There is a continuing demand in the railroad industry to improve trucks including the bolsters and side frames thereof, and to reduce potential stress fractures or cracks in bolsters and side frames.

SUMMARY

Various embodiments of the present disclosure provide a new railroad car, and more particularly a new railroad car truck including one or more new side frames that each includes one or more of a plurality of different improvements that individually and in various combinations reduce, inhibit, or minimize the likelihood of stress fractures or cracks in the side frame.

In various embodiments, the present disclosure provides an improved casted single unit or one piece side frame configured to be employed in a freight railroad car truck and that includes one or more of a plurality of different improvements that individually and in various different combinations reduce, inhibit, or minimize the likelihood of stress fractures or cracks in the side frame and thus reduce maintenance expense and time out of service for the truck and the freight railroad car. Certain of these improvements also provide for or facilitate an overall lighter side frame and truck. Such reduced weight increases fuel efficiency and makes the freight railroad car more efficient.

In various embodiments, the present disclosure provides a railroad car truck including, among other components, a first such improved side frame, a second such improved side frame, and a bolster supported by the first side frame and the second side frame. In various embodiments, the present disclosure provides a railroad car including one or more such railroad car trucks.

In various embodiments, the plurality of different improvements to the side frame generally include: (1) front and rear spring seat-to-column turns that each includes a compound radius of curvature; (2) front and rear internal top anti-buckling ribs; (3) a front and rear pedestals that each include an inner compound radius of curvature; (4) internal lower and upper sidewall reinforcement areas or pads; and (5) front and rear three step transition columns.

Other objects, features, and advantages of the present disclosure will be apparent from the following detailed disclosure, taken in conjunction with the accompanying sheets of drawings, wherein like reference numerals refer to like parts.

DETAILED DESCRIPTION

Various embodiments of the present disclosure provide a new side frame for a railroad car truck, a new railroad car truck having one or two new side frames, and a new railroad car having at least one new truck with one or two new side frames. It should be appreciated that the side frame of the present disclosure can be used in connection with any suitable transportation device (such as freight railroad cars).

Figure 1:
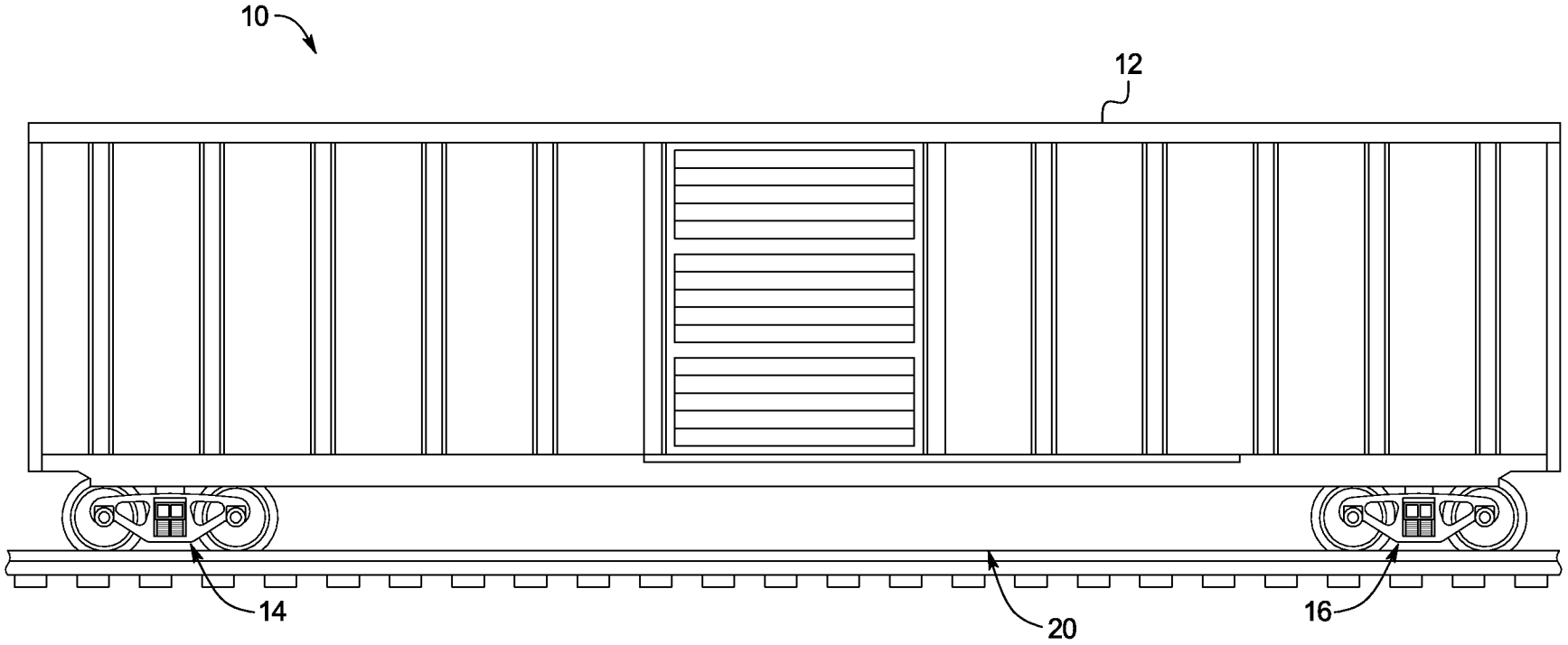
FIG. 1 is a side view of an example freight railroad car of the present disclosure positioned on conventional railroad tracks.
Figure 2:
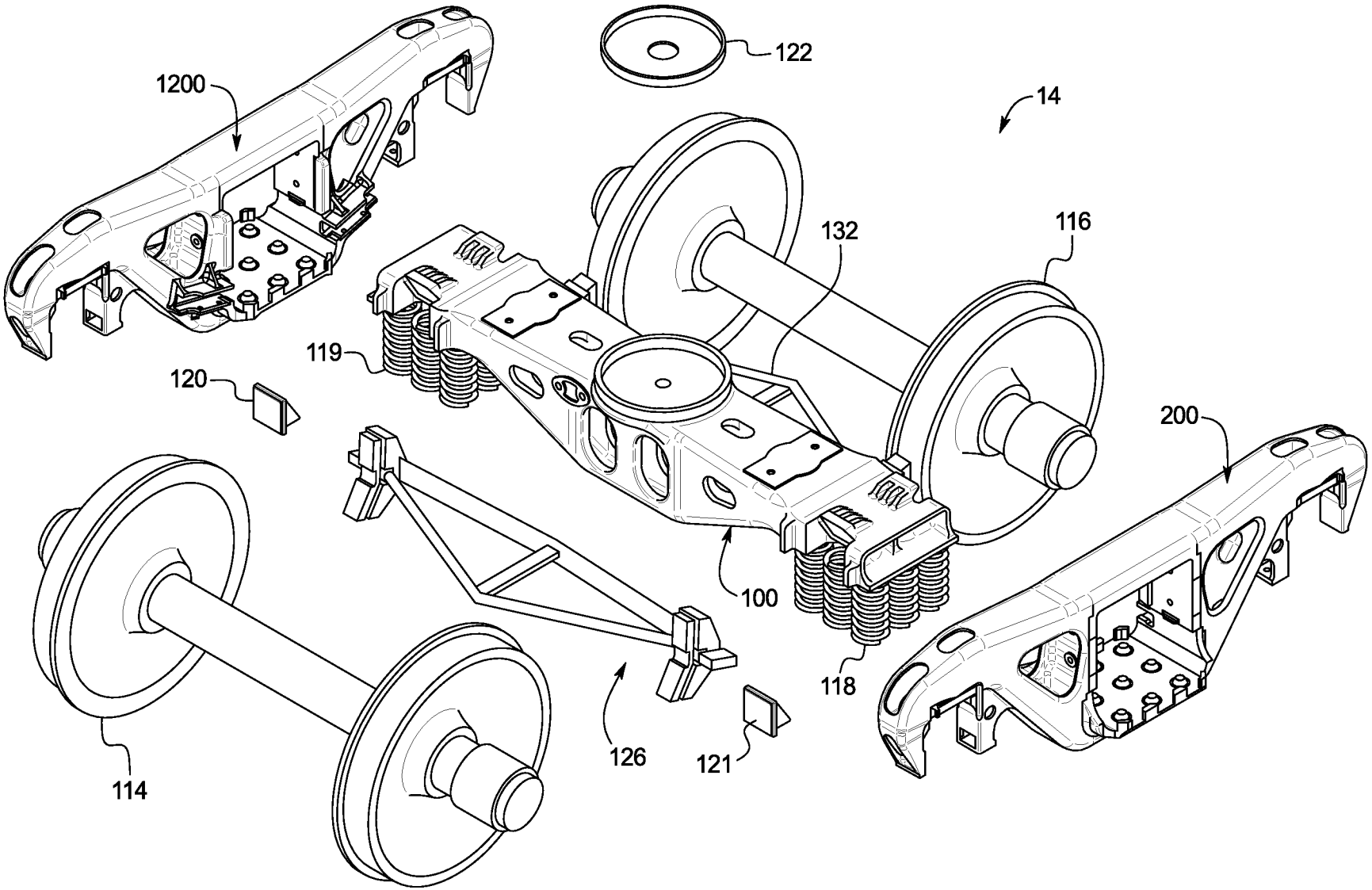
FIG. 2 is an exploded view of certain of the components of an example truck of the example freight railroad car of FIG. 1 which includes one example embodiment of the improved side frames of the present disclosure.
Figure 3:
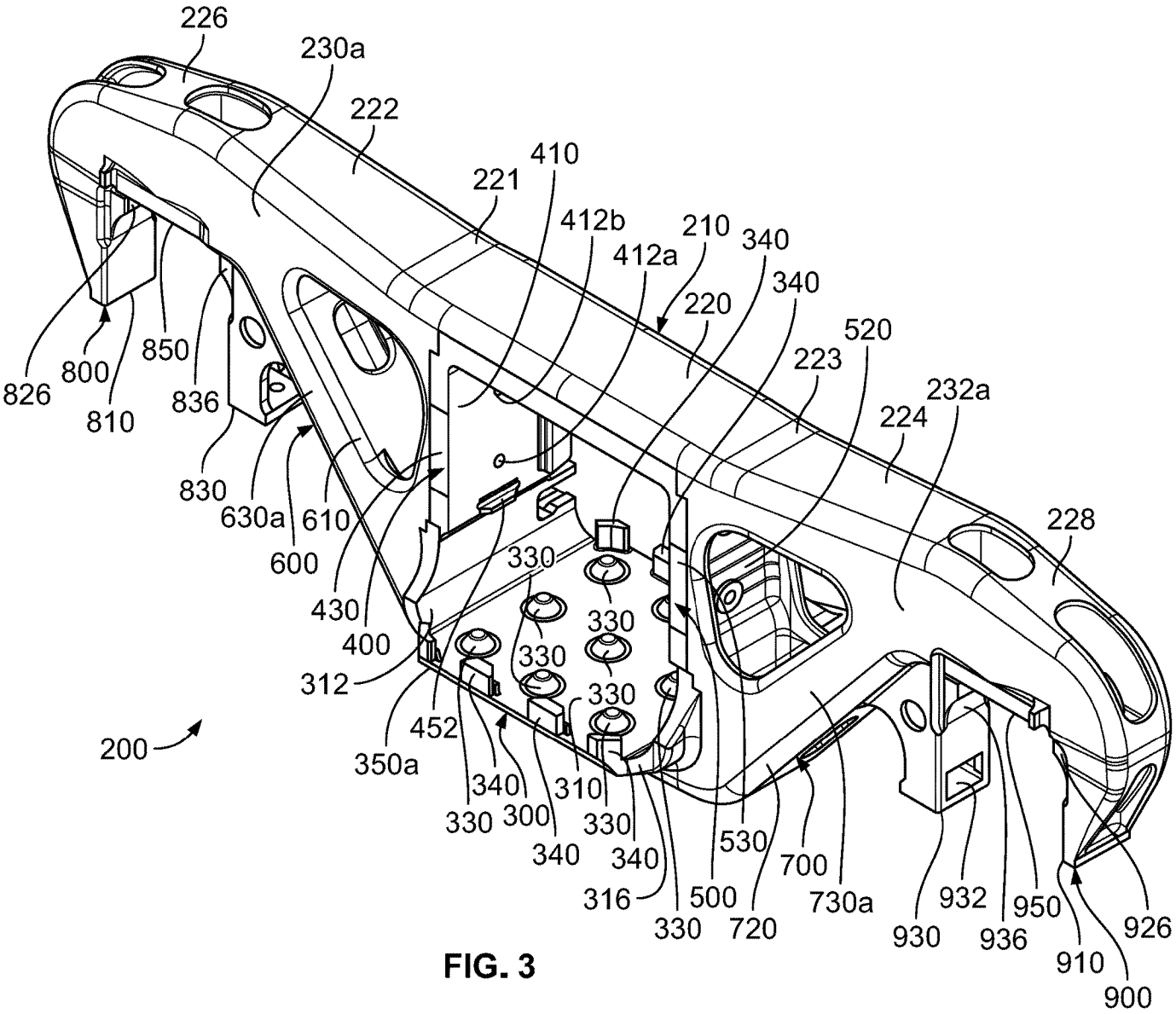
FIG. 3 is a first enlarged outer or field side perspective view of an example side frame of the truck of FIG. 2.
Figure 4:
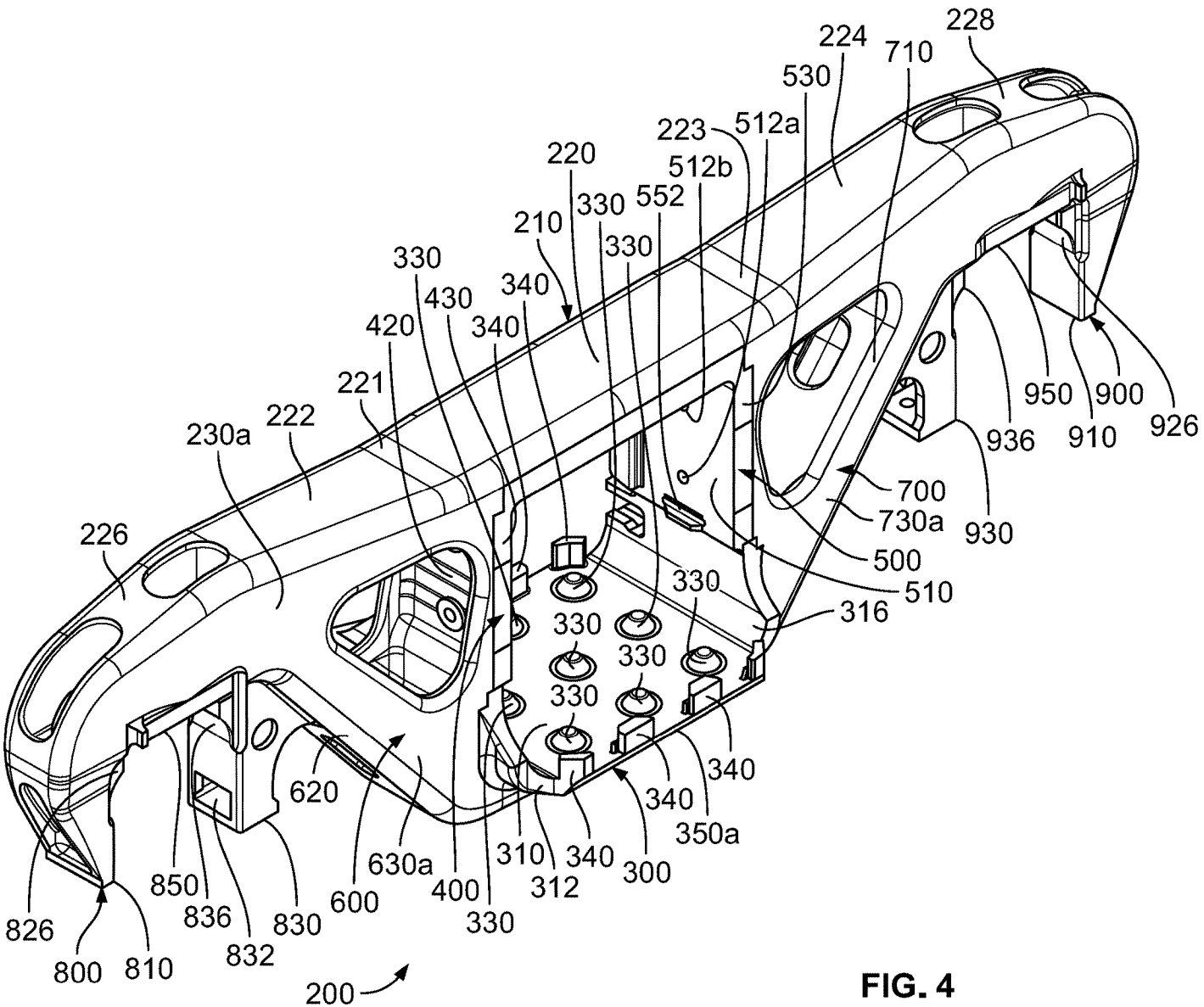
FIG. 4 is a second enlarged outer or field side perspective view of the example side frame of FIG. 3.
Figure 5:
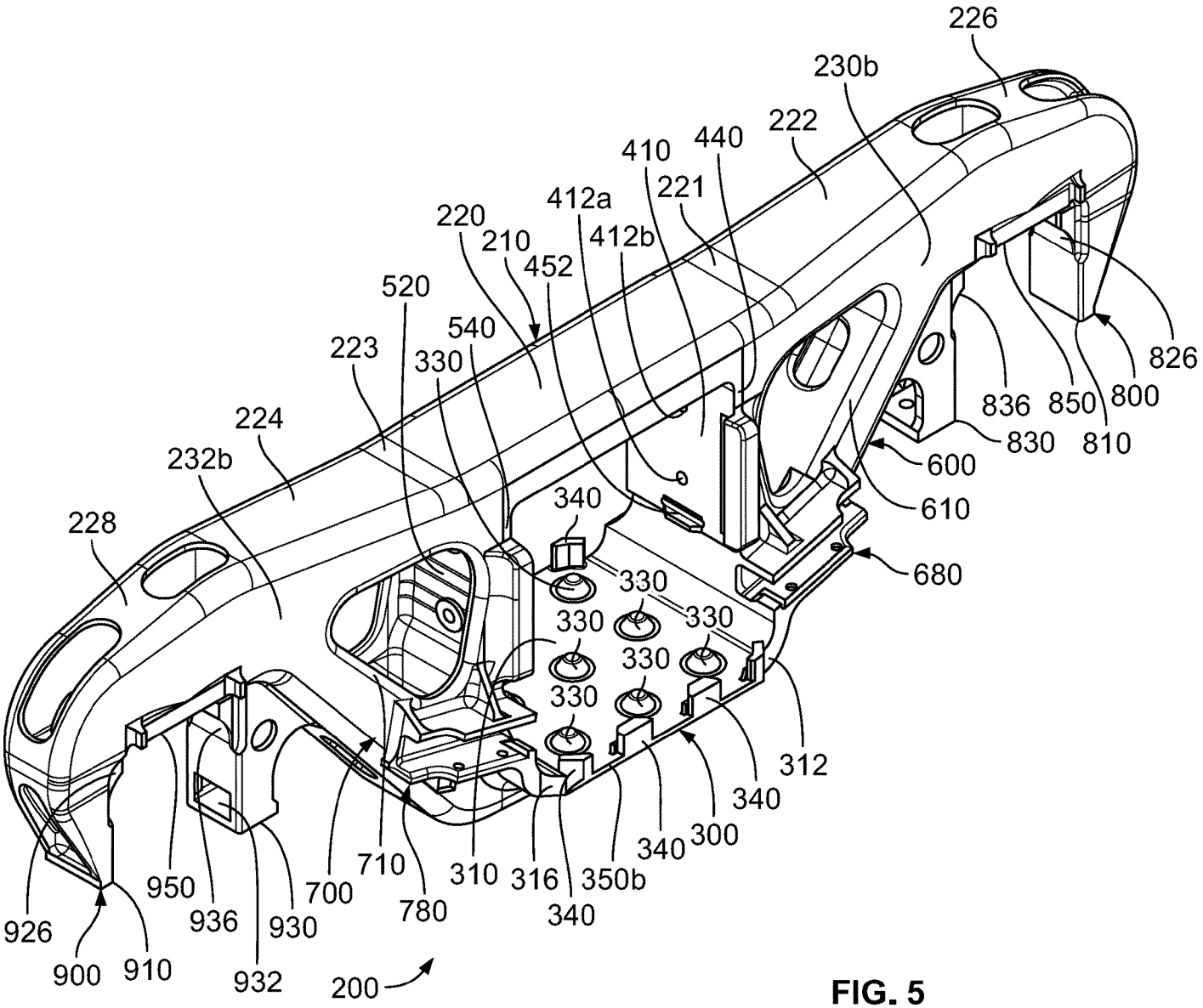
FIG. 5 is an enlarged inner or gage side perspective view of the example side frame of FIG. 3.
Figure 6:
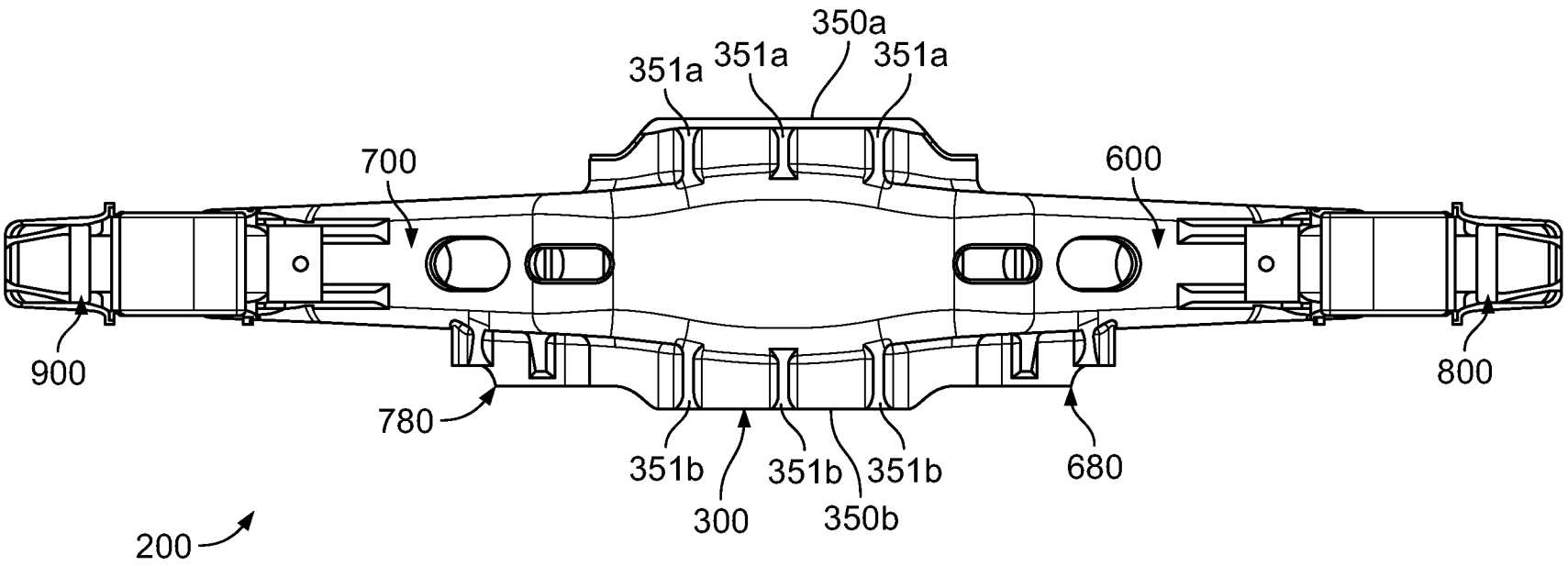
FIG. 6 is a bottom view of the example side frame of FIG. 3.
Figure 7:
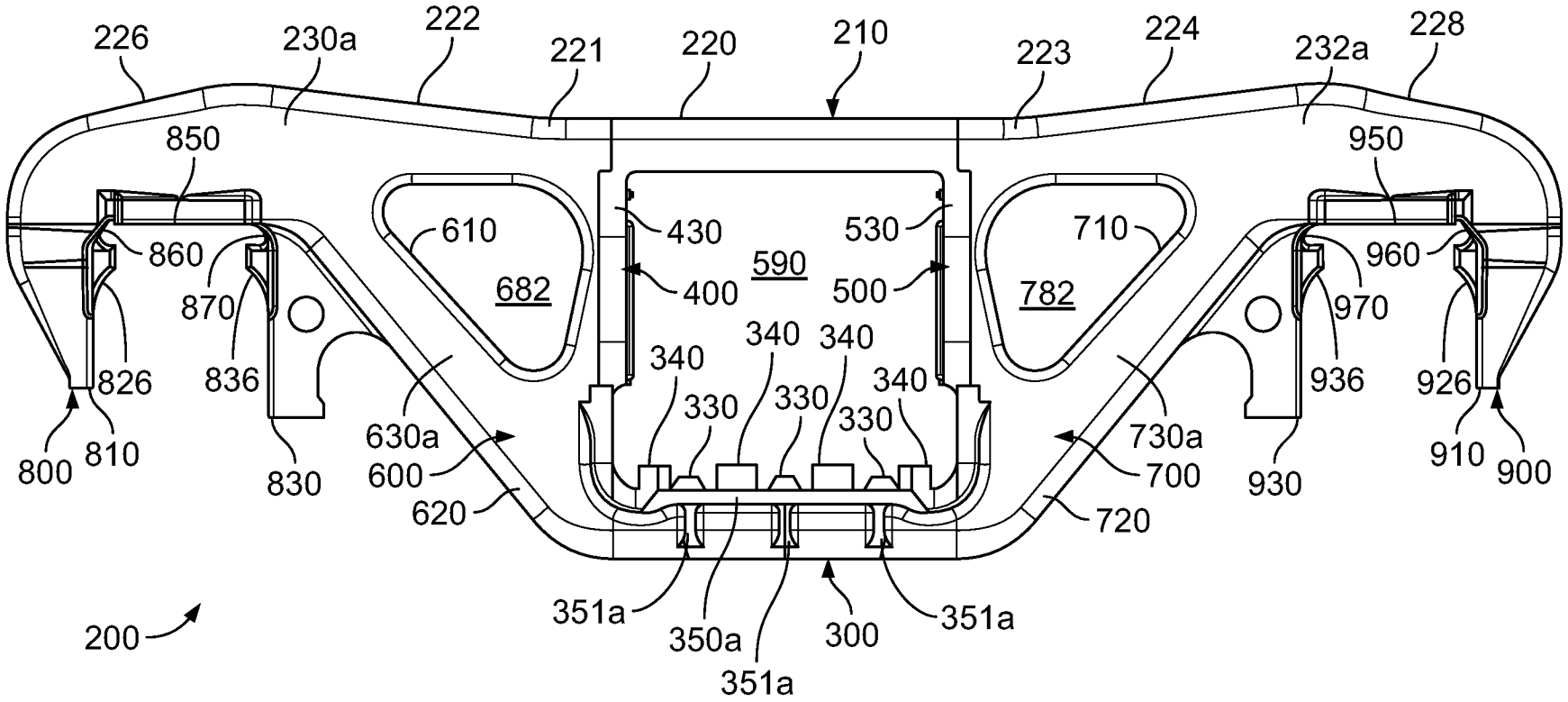
FIG. 7 is a side view of the outer or field side of the example side frame of FIG. 3.
Figure 8:
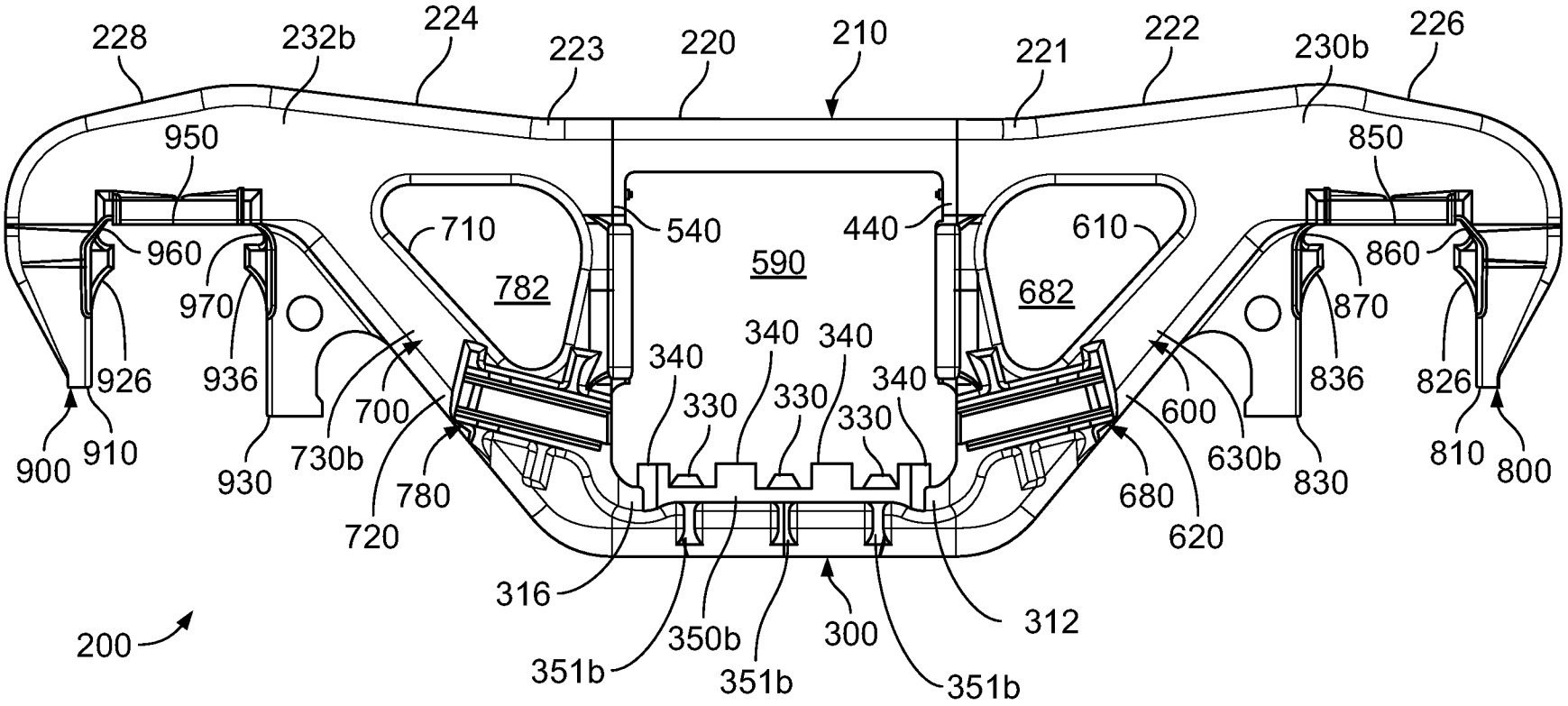
FIG. 8 is a side view of the inner or gage side of the example side frame of FIG. 3.
Figure 9:
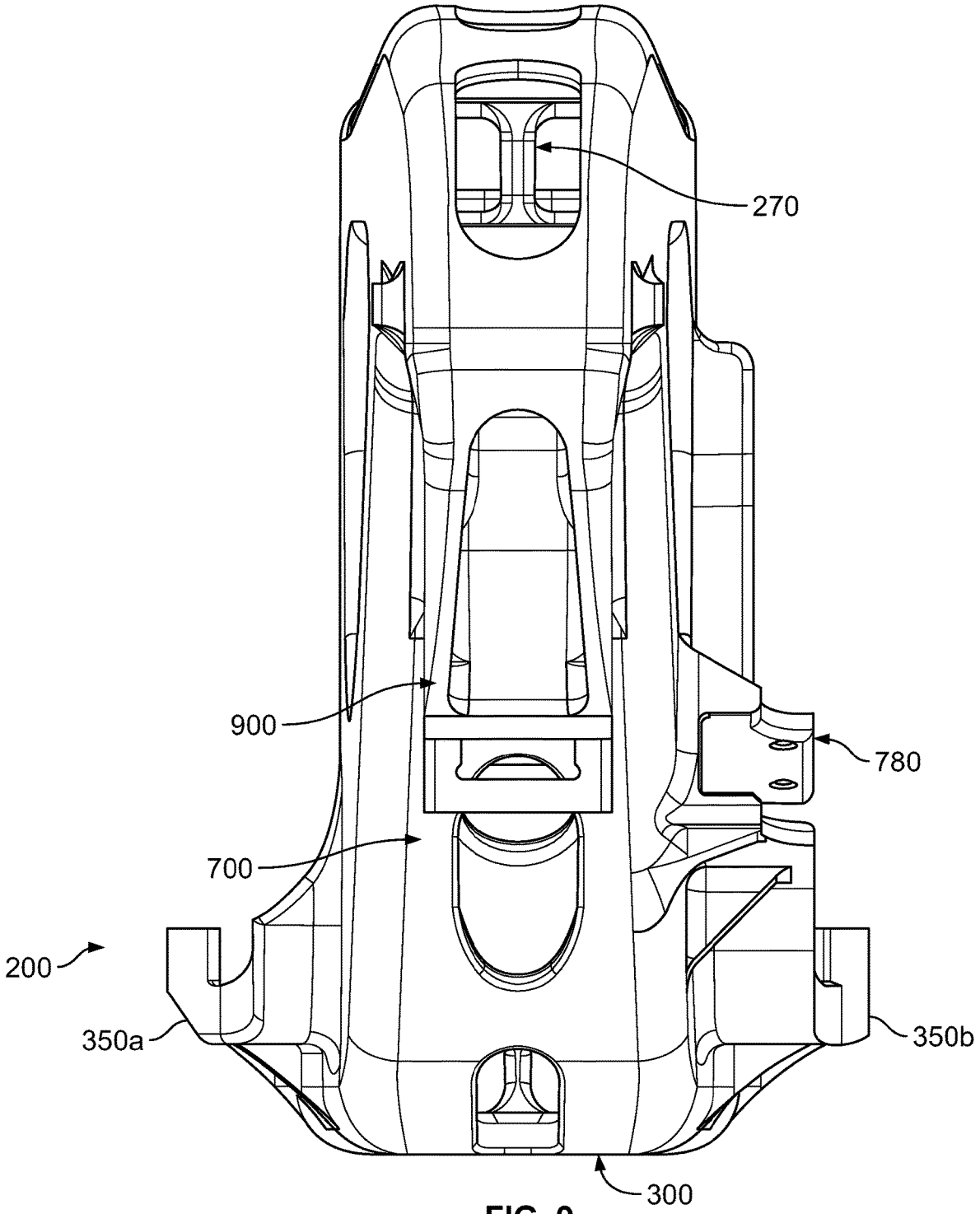
FIG. 9 is an enlarged front end view of the example side frame of FIG. 3.
Figure 10:
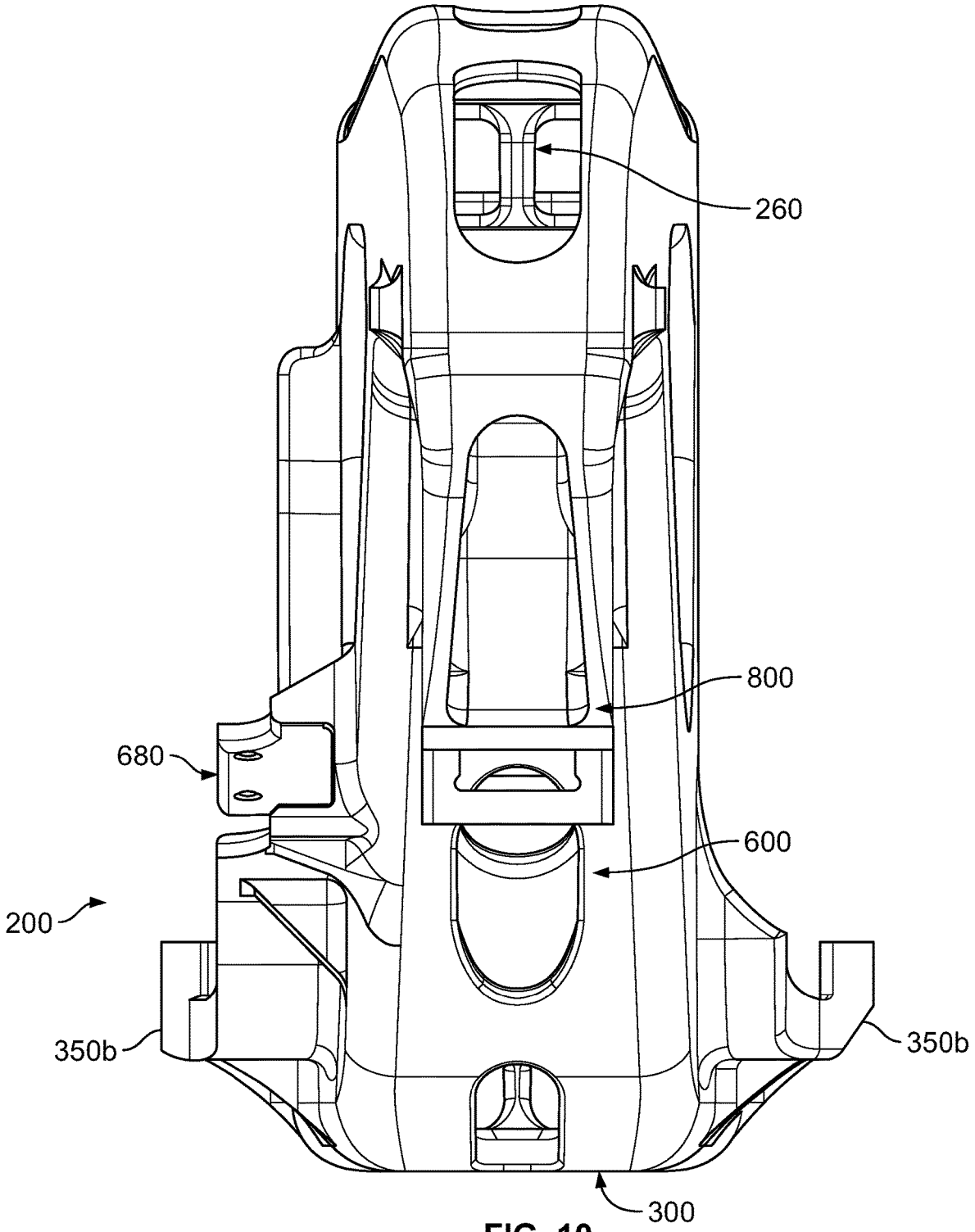
FIG. 10 is an enlarged rear end view of the example side frame of FIG. 3.
Figure 11:
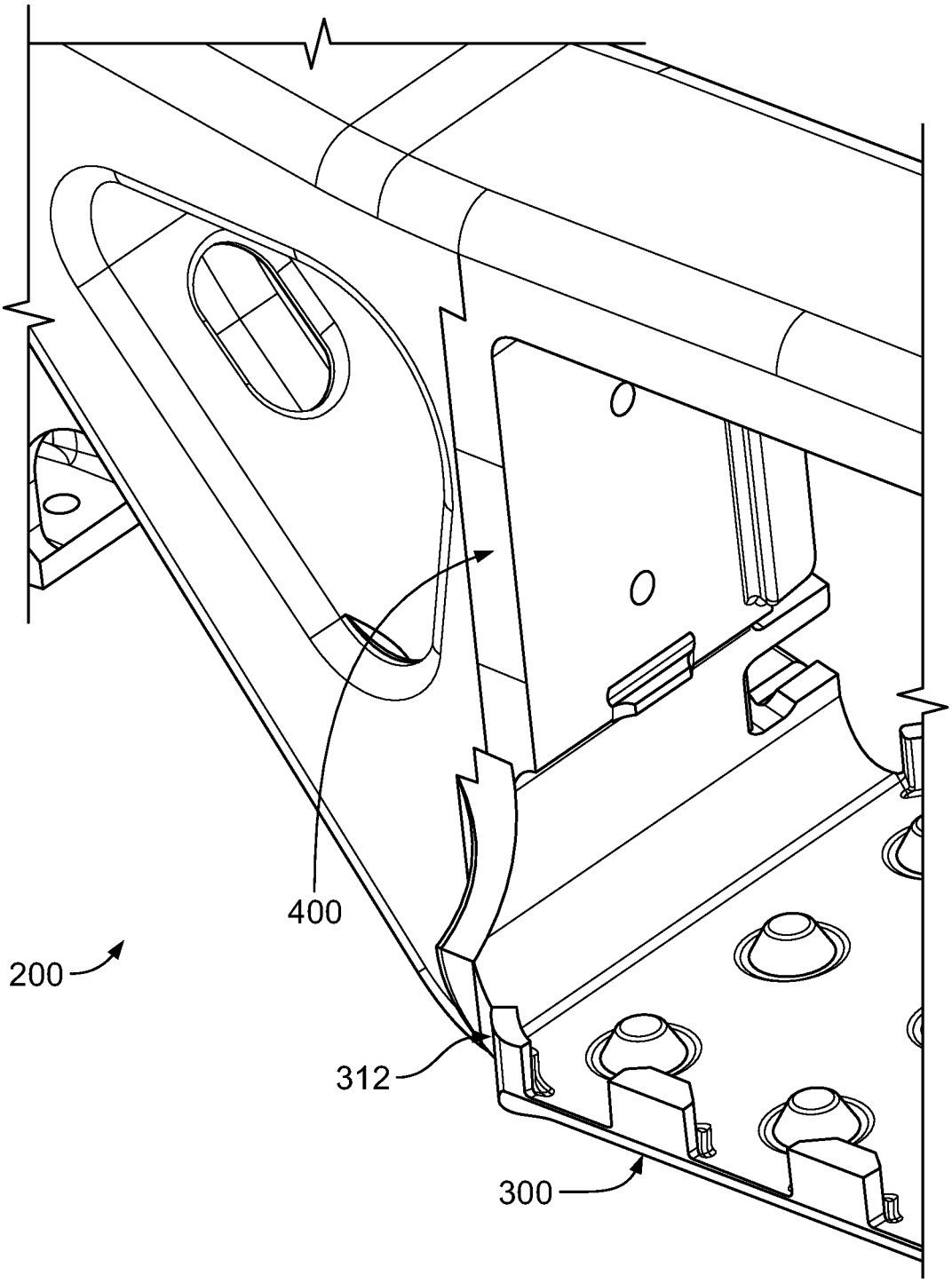
FIG. 11 is an enlarged fragmentary perspective view of the spring seat and the front column that partially defines the bolster opening of the example side frame of FIG. 3.
Figure 12:
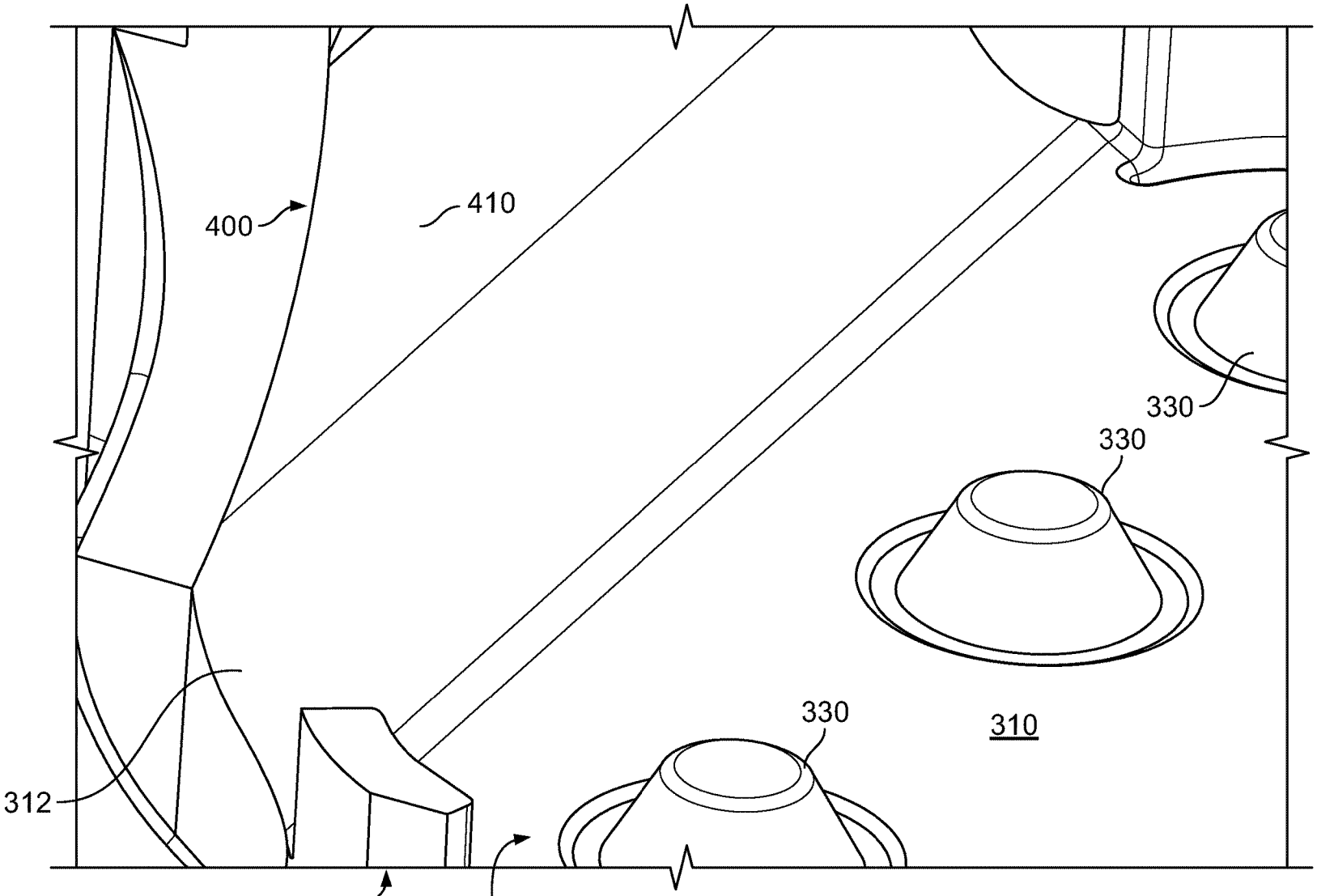
FIG. 12 is a further enlarged fragmentary perspective view of the spring seat and the front column that partially defines the bolster opening of the example side frame of FIG. 3.

Referring now to the drawings, FIGS. 1 and 2 illustrate one example embodiment of such a new railroad car, a new railroad car truck, and two new railroad car truck side frames of the present disclosure. These new side frames are generally indicated by numerals 200 and 1200. In this illustrated example embodiment, the side frames 200 and 1200 are included in an example freight railroad car 10 configured to be positioned on conventional railroad tracks 20. The freight railroad car 10 generally includes a car body 12, a first truck 14, and a second truck 16. It should be understood that the first truck 14 and the second truck 16 are identical or substantially identical in this illustrated example embodiment. Each of the first truck 14 and the second truck 16 includes two side frames 200 and 1200 (i.e., right and left side frames that are mirror images of each other). The railroad car 10 is configured to roll along the tracks 20 via the first truck 14 and the second truck 16 in a conventional manner. The car body 12 rotatably rests on the first truck 14 and the second truck 16 in a conventional manner to navigate (e.g., accommodate, traverse, etc.) curves (not shown) in the tracks 20.

In this illustrated example embodiment, the first truck 14 (as shown in FIG. 2) includes, among many conventional components (that are not shown or described): (1) the first side frame 200; (2) the second side frame 1200; (3) a bolster 100 extending between the first side frame 200 and the second side frame 1200; (4) a first rolling assembly 114; (5) a second rolling assembly 116; (6) a first spring set 118; (7) a second spring set 119; (8) friction wedges such as first and second friction wedges 120 and 121; (9) a bolster bowl wear liner 122; and (10) brake assemblies including brake assembly 126, all configured in a generally conventional manner except as described below. The bolster 100 is configured to be partly positioned in the first side frame 200 and in the second side frame 1200, and is resiliently supported by the first side frame 200 and by the second side frame 1200 via respective spring sets 118 and 119 in a conventional manner. When the first truck 14 is assembled, the bolster bowl wear liner 122 is positioned in the bowl of the bolster 100. The first side frame 200 and the second side frame 1200 extend generally longitudinally in the same direction as the tracks 20 of FIG. 1. Thus, the bolster 100 extends generally transversely to the direction of (e.g., across) the railroad tracks 20 (as generally shown in FIG. 1). The various components of the trucks 14 and 16 that are not shown can be conventional or new components (as will be appreciated by one of skill in the art) and will thus not be described herein.

In this example illustrated embodiment, the example side frame 200 and the example side frame 1200 are identical or mirror images of each other, and thus only example side frame 200 will be described herein in more detail. It should be appreciated that the side frames do not need to be identical or mirror images of each other in accordance with the present disclosure.

It should be appreciated that for an understanding of the side frame improvements of the present disclosure, not every part, wall, surface, and curvature of the side frame 200 needs to be described herein. Rather, the main components of the side frame 200 are generally described herein, and each of the specific side frame improvements of the present disclosure are described herein in more detail.

The illustrated example side frame 200, as best shown in FIGS. 3 to 10, generally includes: (1) a top member 210; (2) a bottom member 300 spaced apart from the top member 210; (3) a front column 400 connecting the top member 210 and the bottom member 300; (4) a rear column 500 connecting the top member 210 and the bottom member 300 and spaced apart from the front column 400; (5) a front angled or diagonal tension member 600 connecting the top member 210 and the bottom member 300; (6) a rear angled or diagonal tension member 700 connecting the top member 210 and the bottom member 300; (7) a front pedestal 800 connected to the top member 210 and the front angled or diagonal tension member 600; (8) a rear pedestal 900 connected to the top member 210 and the rear angled or diagonal tension member 700; (9) a front brake beam bracket 680 connected to and extending from an inner portion of the front angled or diagonal tension member 600; and (10) a rear brake beam bracket 780 connected to and extending from an inner portion of the rear angled or diagonal tension member 700. It should be understood that the top member 210, the bottom member 300, the front column 400, then rear column 500, the front angled or diagonal tension member 600, the rear angled or diagonal tension member 700, the front pedestal 800, the rear pedestal 900, the front brake beam bracket 680, and the rear brake beam bracket 780 are all formed or cast together and integrally and monolithically connected to one another during a suitable casting process in this illustrated example embodiment. Thus, the side frame 200 is a single, integral, unitary, or one piece structure in this illustrated example embodiment.

More specifically, the top member 210 generally includes: (1) a top center member 220; (2) a top front compression member 222 connected to and extending from the top center member 220; (3) a top rear compression member 224 connected to and extending from the top center member 220; (4) a top front end member 226 connected to and extending from the top front compression member 222; (5) a top rear end member 228 connected to and extending from the top rear compression member 224; (6) top front compression member flanges 230*a* and 230*b*; and (7) top rear compression member flanges 232*a* and 232*b*. In this illustrated embodiment, these parts or components of the top member 210 are conventionally configured and arranged.

The bottom member 300 includes: (1) a spring seat 310; (2) a plurality of upwardly extending spring seat bosses 330 connected to and extending from the spring seat 310; and (3) a plurality of upwardly extending inner and outer spring seat lugs 340 connected to and extending from the spring seat 310. The spring seat 310 includes inner and outer outwardly extending spring seat flanges 350*a* and 350*b* and a plurality of respective inner and outer spring seat ribs 351*a* and 351*b*. In this illustrated embodiment, except as described below, these parts or components of the bottom member 300 are conventionally configured and arranged.

The front column 400 includes: (1) an inner wall 410 having a column face and defining column wear plate retainer holes 412*a* and 412*b*; (2) an outer wall 420; (3) an inner side wall 430; (4) an outer side wall 440; (5) an upper column wear plate retainer bead (not shown); and (6) a lower column wear plate retainer bead 452. The front column 400 is integrally connected to and extends between the top center member 220 and the bottom member 300. A front column wear plate (not shown) is connectable to the inner wall 410 of the front column 400. In this illustrated embodiment, except as described herein, these parts or components of the front column 400 are conventionally configured and arranged.

The rear column 500 includes: (1) an inner wall 510 having a column face and defining column wear plate retainer holes 512*a* and 512*b*; (2) an outer wall 520; (3) an inner side wall 530; (4) an outer side wall 540; (5) an upper column wear plate retainer bead (not shown); and (6) a lower column wear plate retainer bead 552. The rear column 500 is integrally connected to and extends between the top center member 220 and the bottom member 300. A rear column wear plate (not shown) is connectable to the inner wall 510 of the rear column 500. In this illustrated embodiment, except as described herein, these parts or components of the rear column 500 are conventionally configured and arranged.

The rear column 500 is spaced apart from the front column 400, such that the front column 400, the rear column 500, the top center member 220, and the bottom member 300 define a bolster receiving opening 590.

The front angled or diagonal tension member 600 includes: (1) a top angled wall 610; (2) a bottom angled wall 620; and (3) front tension member flanges 630*a* and 630*b*. The top compression member 222, the front column 400, and the front angled or diagonal tension member 600 defines the front window 682 of the side frame 200. In this illustrated embodiment, these parts or components of the member 600 are conventionally configured and arranged.

The rear angled or diagonal tension member 700 includes: (1) a top angled wall 710; (2) a bottom angled wall 720; and (3) front tension member flanges 730*a* and 730*b*. The top compression member 224, the rear column 500, and the rear angled or diagonal tension member 700 defines the rear window 782 of the side frame 200. In this illustrated embodiment, these parts or components of the member 700 are conventionally configured and arranged.

The front pedestal 800 includes: (1) an outer pedestal leg 810; (2) an inner pedestal leg 830 that defines a retainer key slot 832; (3) a pedestal roof 850; (4) an outer pedestal thrust lug 826; and (5) an inner pedestal thrust lug 836. In this illustrated embodiment, except as described herein, these parts or components of the front pedestal 800 are conventionally configured and arranged.

The rear pedestal 900 includes: (1) an outer pedestal leg 910; (2) an inner pedestal leg 930 that defines a retainer key slot 932; (3) a pedestal roof 950; (4) an outer pedestal thrust lug 926; and (5) an inner pedestal thrust lug 936. In this illustrated embodiment, except as described herein, these parts or components of the rear pedestal are conventionally configured and arranged.

The illustrated example embodiment of the side frame 200 of the present disclosure includes the following combination of five specific improvements or features or sets of improvements or features including: (1) front and rear turns 312 and 316 from the spring seat 310 to the respective front and rear columns 400 and 500 each including a stress reducing compound radius of curvature; (2) front and rear strengthening internal top anti-buckling ribs 260 and 270; (3) inner turns from each of the inner pedestal roofs 850 and 950 to the respective inner pedestal thrust lugs 826 and 926 each including a stress reducing compound radius of curvature; (4) internal lower and upper sidewall reinforcement areas or pads 290, 292, 294, 296, 390, 392, 394, and 396 (best seen in FIGS. 22 and 23); and (5) the inner walls 410 and 510 of the respective front and rear columns 400 and 500 each having a three step transition profile. It should be appreciated that any suitable one or combination of these different improvements to the side frame can be employed in accordance with the present disclosure.

Figure 13A:
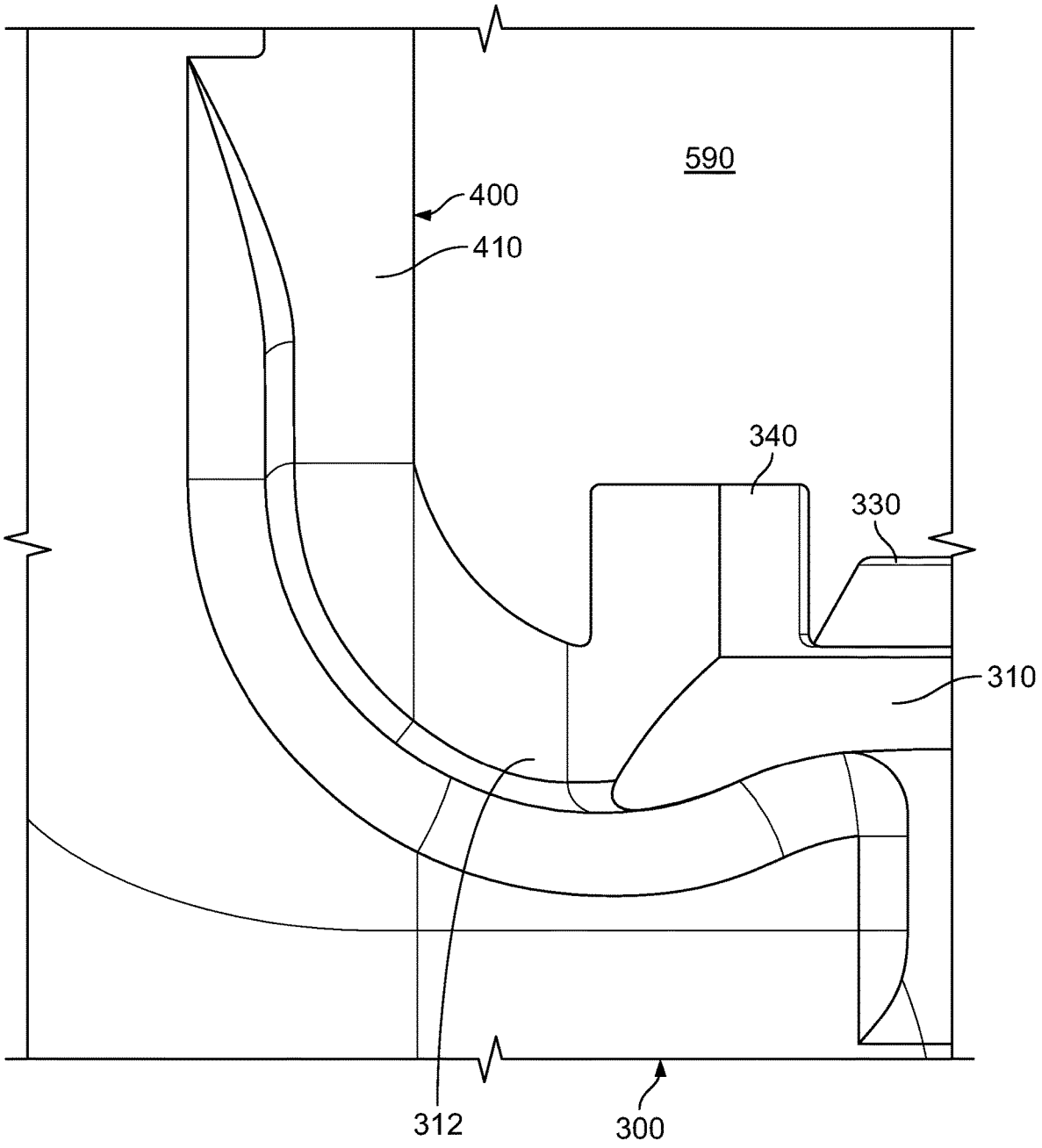
FIG. 13A is an enlarged fragmentary diagrammatic side view of the spring seat and the front column that partially defines the bolster opening of the example side frame of FIG. 3, indicating the respective radiuses of curvature of the turn connecting the spring seat and the front column of this example side frame of FIG. 3.
Figure 13B:
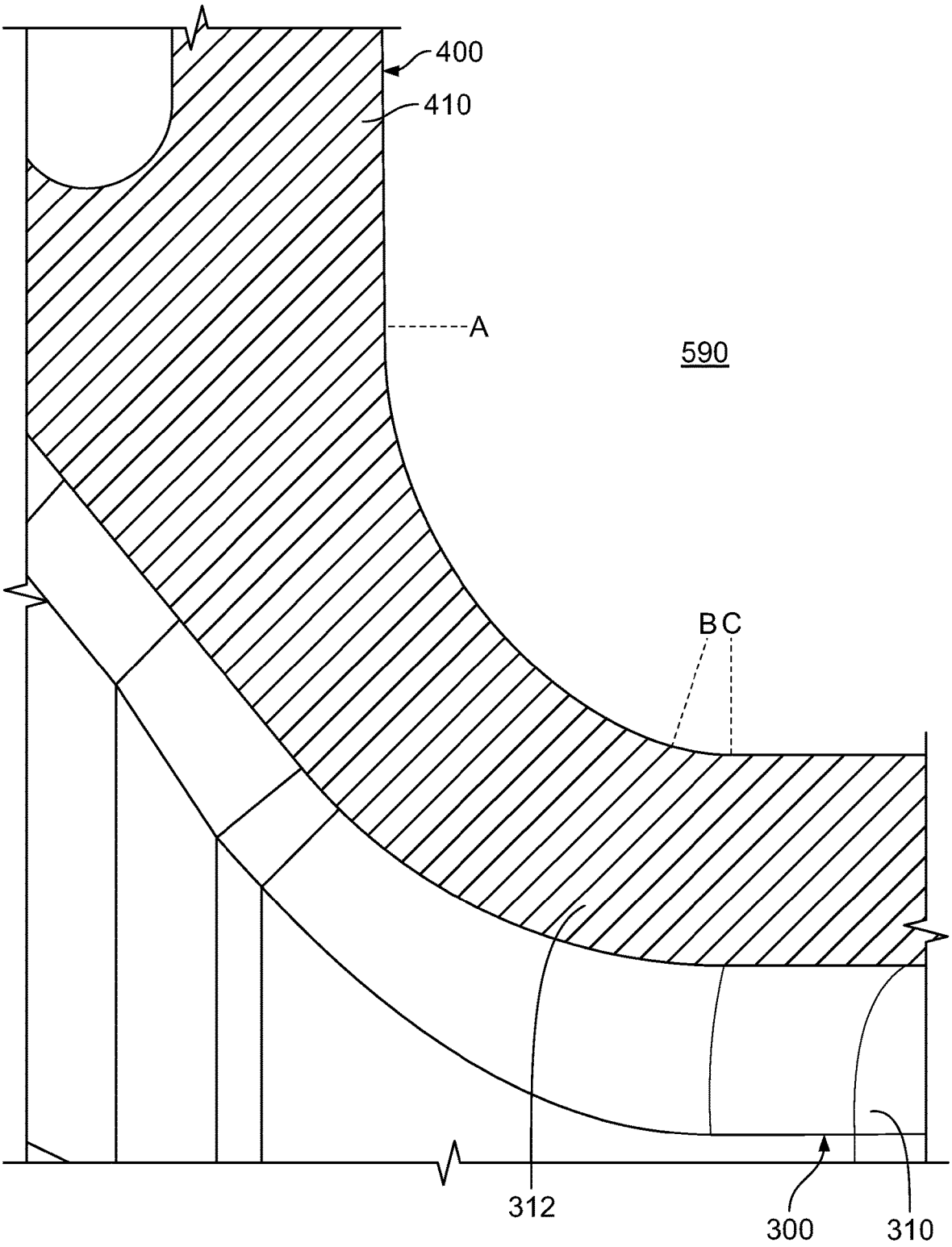
FIG. 13B is an enlarged fragmentary cross-sectional view of the spring seat and the front column that partially defines the bolster opening of the example side frame of FIG. 3, indicating the respective radiuses of curvature of the turn connecting the spring seat and the front column of this example side frame of FIG. 3.

More specifically, as best shown in FIGS. 3, 4, 5, 7, 8, 11, 12, 13A, and 13B, the side frame 200 includes: (1) the bottom member 300 including a front turn 312 from the spring seat 310 to the front column 400 that includes a compound radius of curvature; and (2) the bottom member 300 including a rear turn 316 from the spring seat 310 to the rear column 500 that includes a stress reducing compound radius of curvature. The front turn 312 from the spring seat 310 provides the transition between the spring seat 310 and the vertical front column 400 that partially defines the bolster opening 590. In this example illustrated embodiment, the front turn 312 includes two separate different radii of curvature that are tangential to one another to provide the transition from the spring seat 310 to the front column 400. The first radius of curvature is indicated in FIG. 13B extending from phantom line A to phantom line B, and the second radius of curvature is indicated in FIG. 13B extending from phantom line B to phantom line C. Likewise, the rear turn 316 from the spring seat 310 provides the transition between the spring seat 310 and the vertical rear column 500 that partially defines the bolster opening 590. In this example illustrated embodiment, the rear turn 316 includes two separate different radii that are tangential to one another to provide the transition from the spring seat 310 to the rear column 500. In this illustrated example embodiment, the front turn 312 and the rear turn 316 are mirror images of each other, but it should be appreciated that the present disclosure contemplates that they do not need to be identical or mirror images.

In this example embodiment, by providing each respective turn 312 and 316 with two separate different radii of curvature that are tangential to one another, the present disclosure employs a first larger radius of curvature for the majority of each of the respective turns 312 and 316 and a second smaller radius of curvature for a minority of the respective turns 312 and 316 to avoid impeding on the spring seat clearance. In other words, the first larger radius curvature of each turn provides the additional stress reduction for the side frame while the second smaller radius of curvature provides the needed distances for the spring seat clearance. In certain example embodiments, the first radius (that defines the first radius of curvature) of each turn 312 and 316 is approximately 50 millimeters and the second radius (that defines the second radius of curvature) of each turn 312 and 316 is approximately 22.5 millimeters. It should be appreciated that for defining the curvatures of the outer circumference of a circle, a circle having a relatively larger radius has a relatively smaller curvature, and a circle having a relatively smaller radius has a relatively larger curvature.

This configuration of the turns 312 and 316 lowers stresses in each of these relatively high stress areas by approximately 20%. These lower stress levels enable higher loads to be placed on the side frame 200. Additionally, or alternatively, these lower stress levels enable the side frame 200 to be made with one or more thinner walls and thus of a lower weight to provide a lighter weight and more efficient overall railroad car truck.

As best shown in FIGS. 9, 10, 14, 15, 16, and 17, the side frame 200 includes: (1) a front internal top anti-buckling rib 260; and (2) a rear internal top anti-buckling rib 270. In this illustrated example embodiment, the front internal top anti buckling rib 260 and the rear internal top anti buckling rib 270 are mirror images of each other, but it should be appreciated that the present disclosure contemplates that they do not need to be identical or mirror images.

In this illustrated example embodiment, the front anti-buckling rib 260 is located partially above the window 682 and directly below the transition area 221 between the center top member 220 and the top front compression member 222. In this illustrated example embodiment, the front anti-buckling rib 260 is connected to and extends downwardly from the bottom surface of the transition area 221 and is connected to and extends upwardly from the top surface of the top longitudinally forwardly extending top wall 460 connected to the front column 400. In this illustrated example embodiment, the front anti-buckling rib 260 includes: (1) an upright front wall 262; (2) an upright rear wall 264 spaced apart from the front wall 262; (3) an upright first side wall 266 connected to the upright front wall 262 and the upright rear wall 264; and (4) an upright second side wall (not shown) spaced apart from the first side wall 266 and connected to the upright front wall 262 and the upright rear wall 264. In this illustrated example embodiment, the upright front wall 262, the upright rear wall 264, the upright first side wall 266, and the upright second side wall each have a generally concave shape. In this illustrated example embodiment, the upright front wall 262 has a slightly greater height than the upright rear wall 264.

Likewise, the rear anti-buckling rib 270 is located partially above the window 782 and directly below the transition area 223 between the center top member 220 and the top rear compression member 224. In this illustrated example embodiment, the rear anti-buckling rib 270 is connected to and extends downwardly from the bottom surface of the transition area 223 and is connected to and extends upwardly from the top surface of the top longitudinally forwardly extending top wall 560 connected to the front column 500. In this illustrated example embodiment, the rear anti-buckling rib 270 includes: (1) an upright front wall 272; (2) an upright rear wall 274 spaced apart from the front wall 272; (3) an upright first side wall 276 connected to the upright front wall 272 and the upright rear wall 274; and (4) an upright second side wall 278 spaced apart from the first side wall 276 and connected to the upright front wall 272 and the upright rear wall 274. In this illustrated example embodiment, the upright front wall 272, the upright rear wall 274, the upright first side wall 276, and the upright second side wall 278 each have a generally concave shape. In this illustrated example embodiment, the upright front wall 272 has a slightly smaller height than the upright rear wall 274.

This anti-buckling ribs 260 and 270 provide substantial support to certain relatively high stress areas of the side frame 200, and particularly the areas that can experience high compression stresses. This anti-buckling ribs 260 and 270 assist in preventing buckling by lowering compressive stresses by approximately 15%. These lower stress levels enable substantially higher loads to be placed on the side frame 200. Additionally, or alternatively, these lower stress levels enable the side frame 200 to be made with one or more thinner walls and thus lighter or of a lower weight to provide a more efficient overall railroad car truck.

As best shown in FIGS. 7, 8, 18, 19, 20, and 21, the side frame 200 includes: (1) an outer turn 860 from the outer pedestal leg 810 to the pedestal roof 850 that includes a single radius of curvature; (2) an inner turn 870 from the inner pedestal leg 830 to the pedestal roof 850 that includes a compound radius of curvature; (3) an outer turn 960 from the outer pedestal leg 910 to the pedestal roof 950 that includes a single radius of curvature; and (4) an inner turn 970 from the inner pedestal leg 930 to the pedestal roof 950 that includes a compound radius of curvature.

Figure 20:
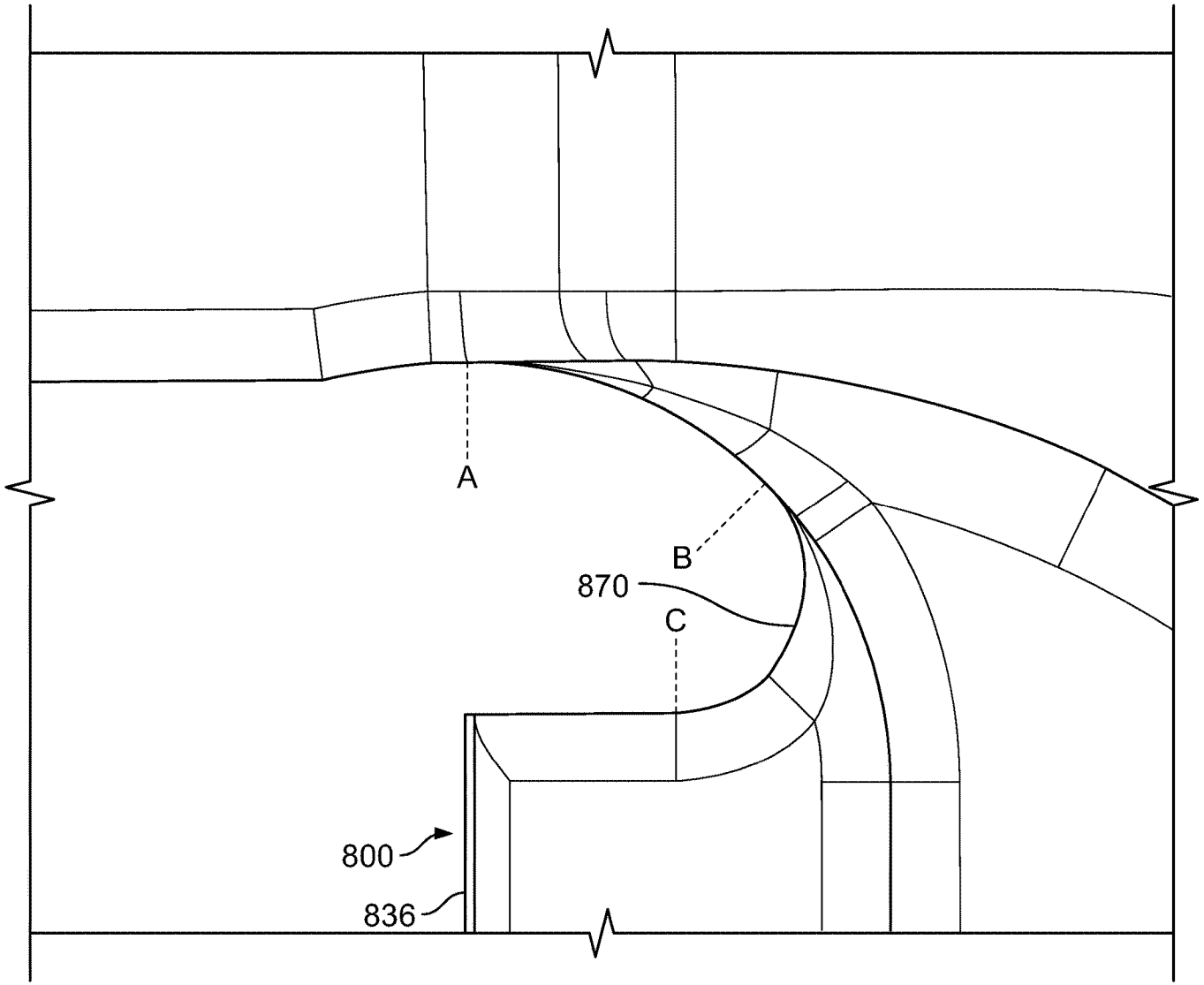
FIG. 20 is a further enlarged fragmentary partial cross-sectional perspective view of part of the front portion of the example side frame of FIG. 3, and indicating the respective radiuses of curvature of the turn connecting the front pedestal roof and the inner pedestal leg.

More specifically, the inner turn 870 from the inner pedestal leg 830 to the pedestal roof 850 extends from the thrust lug 836 and includes two separate different radii of curvature that are tangential to one another to provide this transition. These two radii of curvature are tangential to one another to allow for a larger radius of curvature to be used while also not interfering with the clearance opening of the pedestal roof 850. The first radius of curvature is indicated in FIG. 20 extending from phantom line A to phantom line B, and the second radius of curvature is indicated in FIG. 20 extending from phantom line B to phantom line C.

Likewise, the inner turn 970 from the inner pedestal leg 930 to the pedestal roof 850 extends from the thrust lug 926 and includes two separate different radii of curvature that are tangential to one another to provide this transition. These two radii of curvature are tangential to one another to allow for a larger radius of curvature to be used while also not interfering with the clearance opening of the pedestal roof 950.

In this example embodiment, by providing each respective turn 870 and 970 with two separate different radii of curvature that are tangential to one another, the present disclosure employs a first larger radius of curvature for the majority of each of the respective turns 870 and 970 and a second smaller radius of curvature for a minority of the respective turns 870 and 970 to avoid impeding on the pedestal roof clearance. In other words, the first larger radius of curvature of each turn provides the additional stress reduction for the side frame while the second smaller radius of curvature provides the needed distances for the pedestal roof clearance. In certain example embodiments, the first radius (that defines the first radius of curvature) of each turn 870 and 970 is approximately 38 millimeters and the second radius (that defines the second radius of curvature) of each turn 312 and 316 is approximately 12 millimeters.

Figure 21:
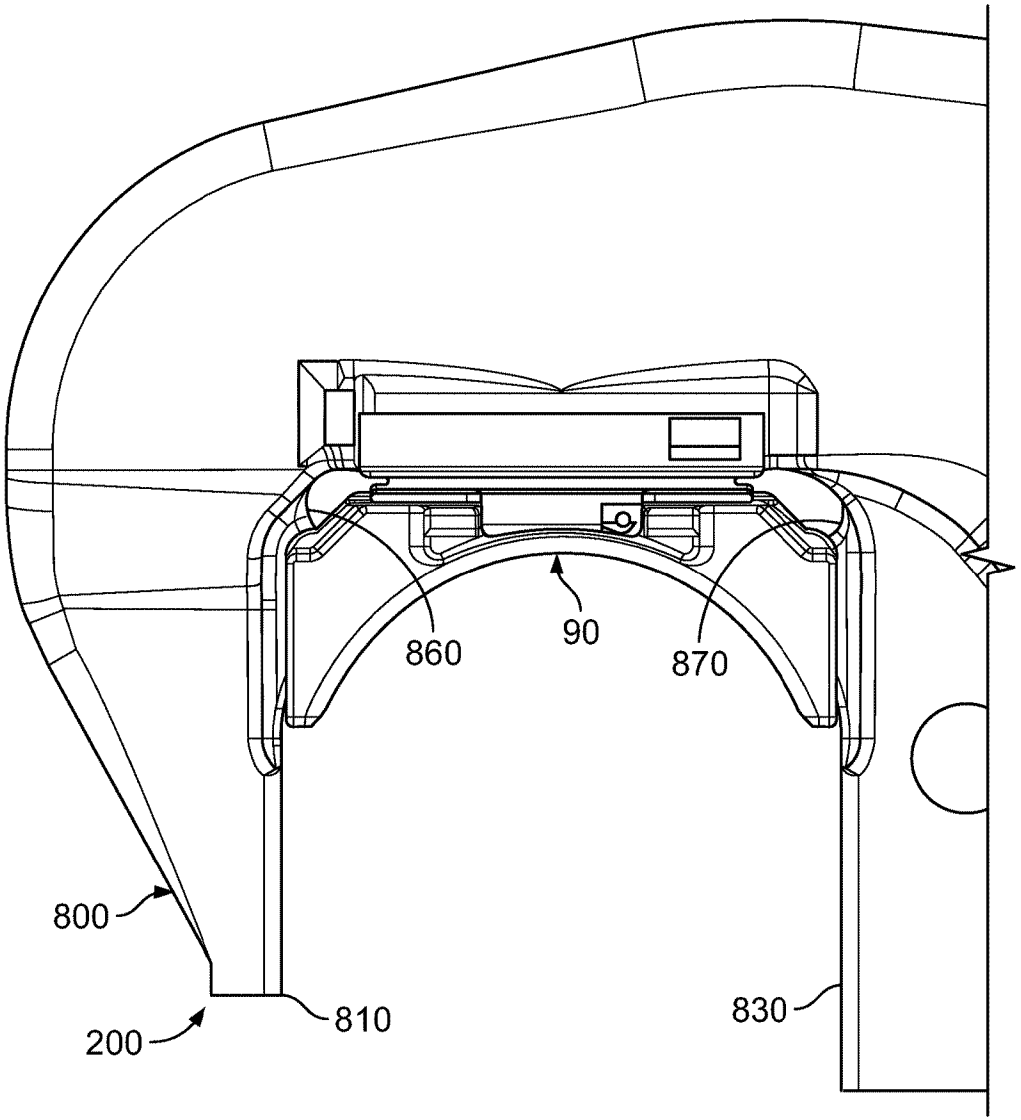
FIG. 21 is an enlarged fragmentary side view of part of the front portion of the example side frame of FIG. 3, and showing the front pedestal roof of this example side frame of FIG. 3 and a roller bearing adaptor assembly positioned adjacent to the front pedestal roof.

FIG. 21 shows a roller bearing adapter assembly 90 positioned in the pedestal 800 and the clearances provided by the outer turn 860 and inner turn 870.

This improvement in the configuration of turns including the inner turn 870 and the inner turn 970 each provide relatively larger radius of curvatures that reduces deformation and assists in distributing stresses evenly to the respective surrounding areas instead of concentrating them at smaller radius of curvatures. These lower stress levels enable higher loads to be placed on the side frame 200. Additionally, or alternatively, these lower stress levels enable the side frame 200 to be made with one or more thinner walls and thus lighter or of a lower weight to provide a more efficient overall railroad car truck.

It should be appreciated that in alternative embodiments of the present disclosure, the outer turn 860 and the outer turn 960 are also each provided with a compound radius of curvature to further reduce deformation and assists in distributing stresses.

Figure 22:
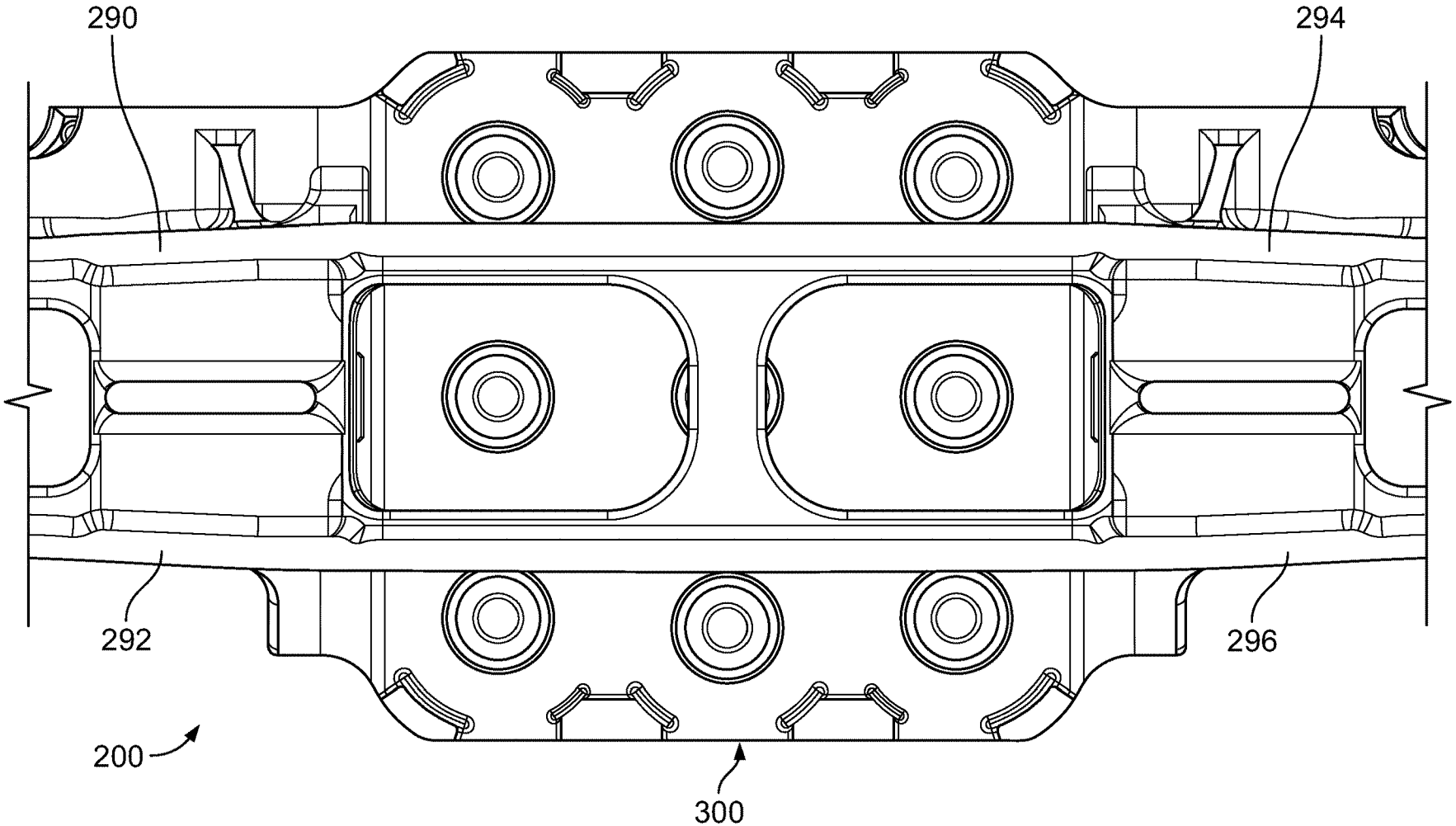
FIG. 22 is an enlarged fragmentary partial cross-sectional view of part of the central portion of the example side frame of FIG. 3, and showing the upper side wall reinforced areas or pads of this example side frame of FIG. 3.
Figure 23:
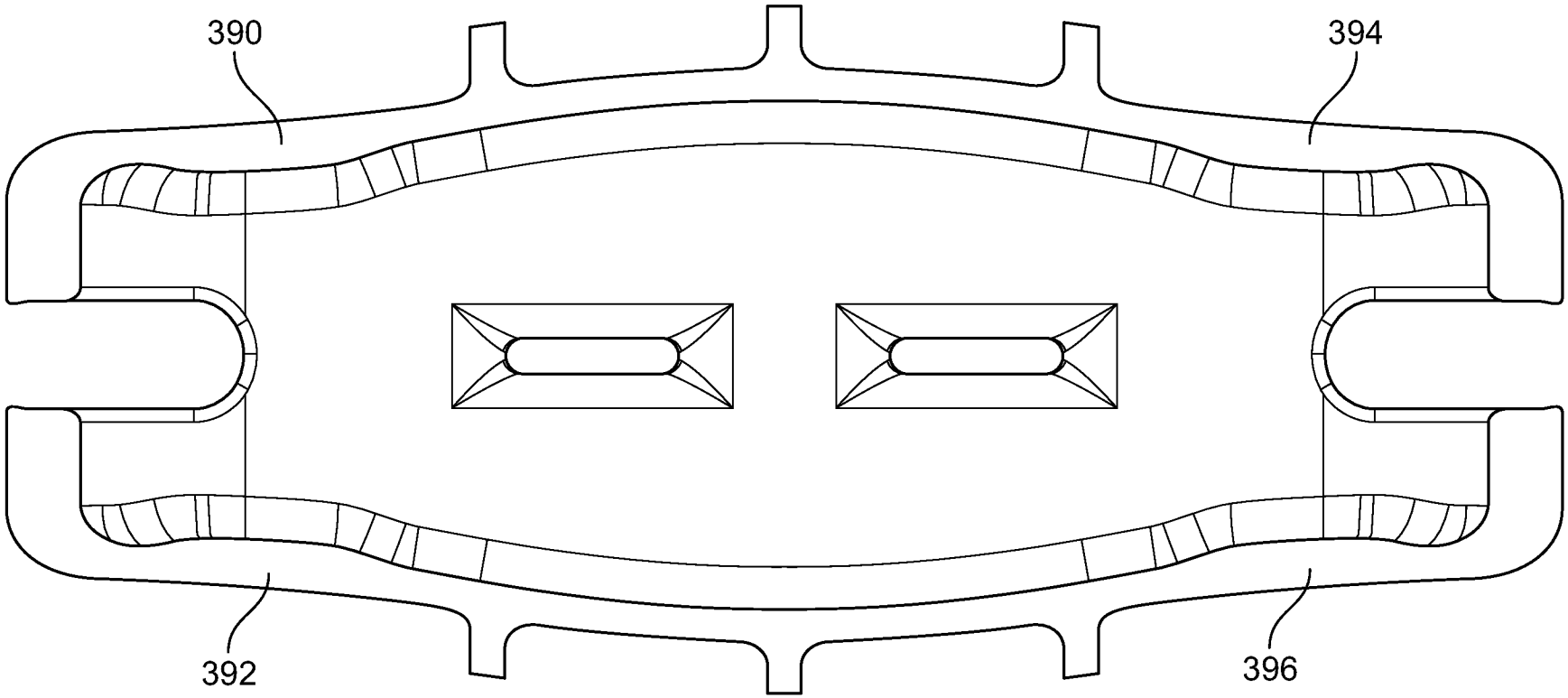
FIG. 23 is an enlarged fragmentary partial cross-sectional view of part of the central portion of the example side frame of FIG. 3, and showing the lower side wall reinforced areas or pads of this example side frame of FIG. 3.

As best shown in FIGS. 22 and 23, the side frame 200 generally includes eight sidewall reinforcement areas or pads that each add extra support by increasing the wall thickness of a vertically extending wall or area in one of the critical areas of the side frame 200.

More specifically, the side frame 200 includes: (1) an internal upper sidewall reinforcement area or pad 290; (2) an internal upper sidewall reinforcement area or pad 292; (3) an internal upper sidewall reinforcement area or pad 294; (4) an internal upper sidewall reinforcement area or pad 296; (5) an internal lower sidewall reinforcement area or pad 390; (6) an internal lower sidewall reinforcement area or pad 392; (7) an internal lower sidewall reinforcement area or pad 394; and (8) an internal lower sidewall reinforcement area or pad 396. These reinforcement areas or pads 290, 292, 294, 296, 390, 392, 394, and 396 are respectively located on the backsides or inner portions of the respective exterior walls.

These internal reinforcement areas or pads 290, 292, 294, 296, 390, 392, 394, and 396 add extra support by increasing wall thickness in critical high deflection areas of the side frame 200 where buckling or cracking can occur. More specifically, the thickened areas or pads are approximately 20 to 22 millimeters thick (i.e., from side to side or transversely to the longitudinal axis of the side frame) as compared to the adjacent non-thickened areas that are approximately 14 to 16 millimeters thick. The additional material that forms the additional thickness is on the respective interior sections of those thickened areas.

The use of these reinforcement areas or pads 290, 292, 294, 296, 390, 392, 394, and 396 lowers the likelihood of stress cracks or failures from happening. These lower deflections and stress levels enable higher loads to be placed on the side frame. These lower deflections and lower stress levels also enable the side frame to be made with one or more thinner walls and thus lighter to provide a more efficient overall truck.

Figure 14:
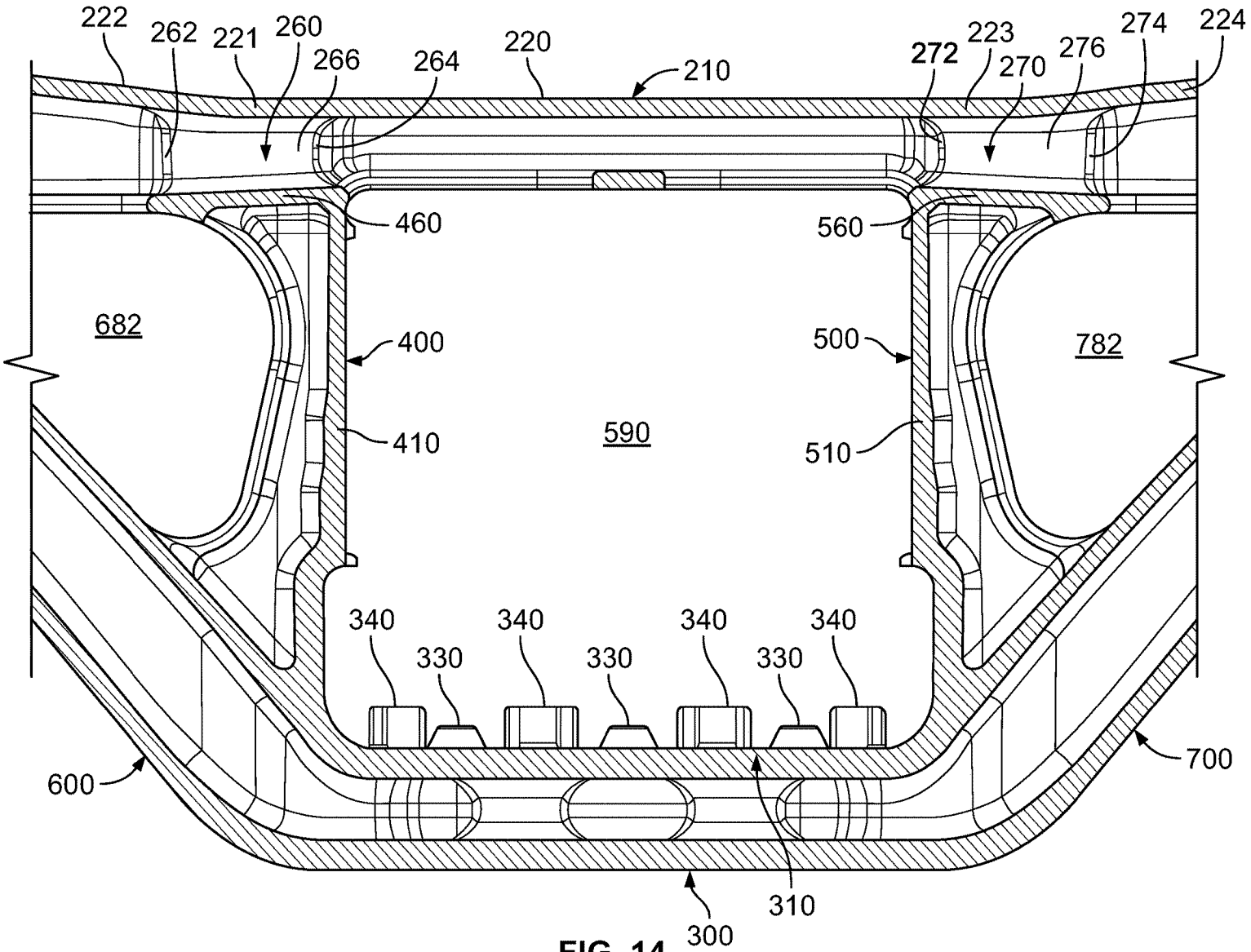
FIG. 14 is an enlarged fragmentary cross-sectional view of the central portion of the example side frame of FIG. 3, and showing the front and rear internal top anti-buckling ribs of this example side frame of FIG. 3.
Figure 15:
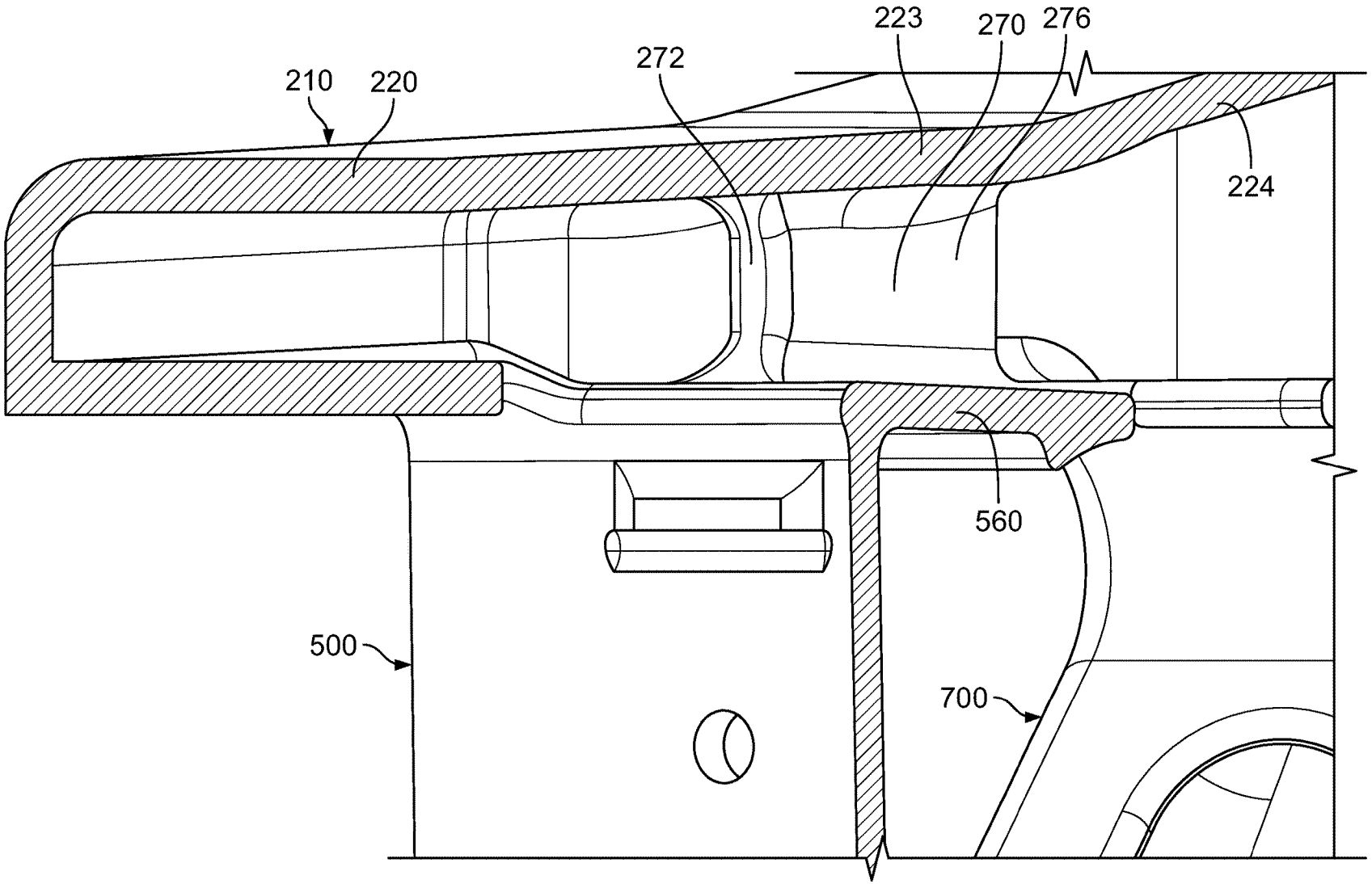
FIG. 15 is an enlarged fragmentary partial cross-sectional perspective view of part of the central portion of the example side frame of FIG. 3, and showing the rear internal top anti-buckling rib of this example side frame of FIG. 3.
Figure 16:
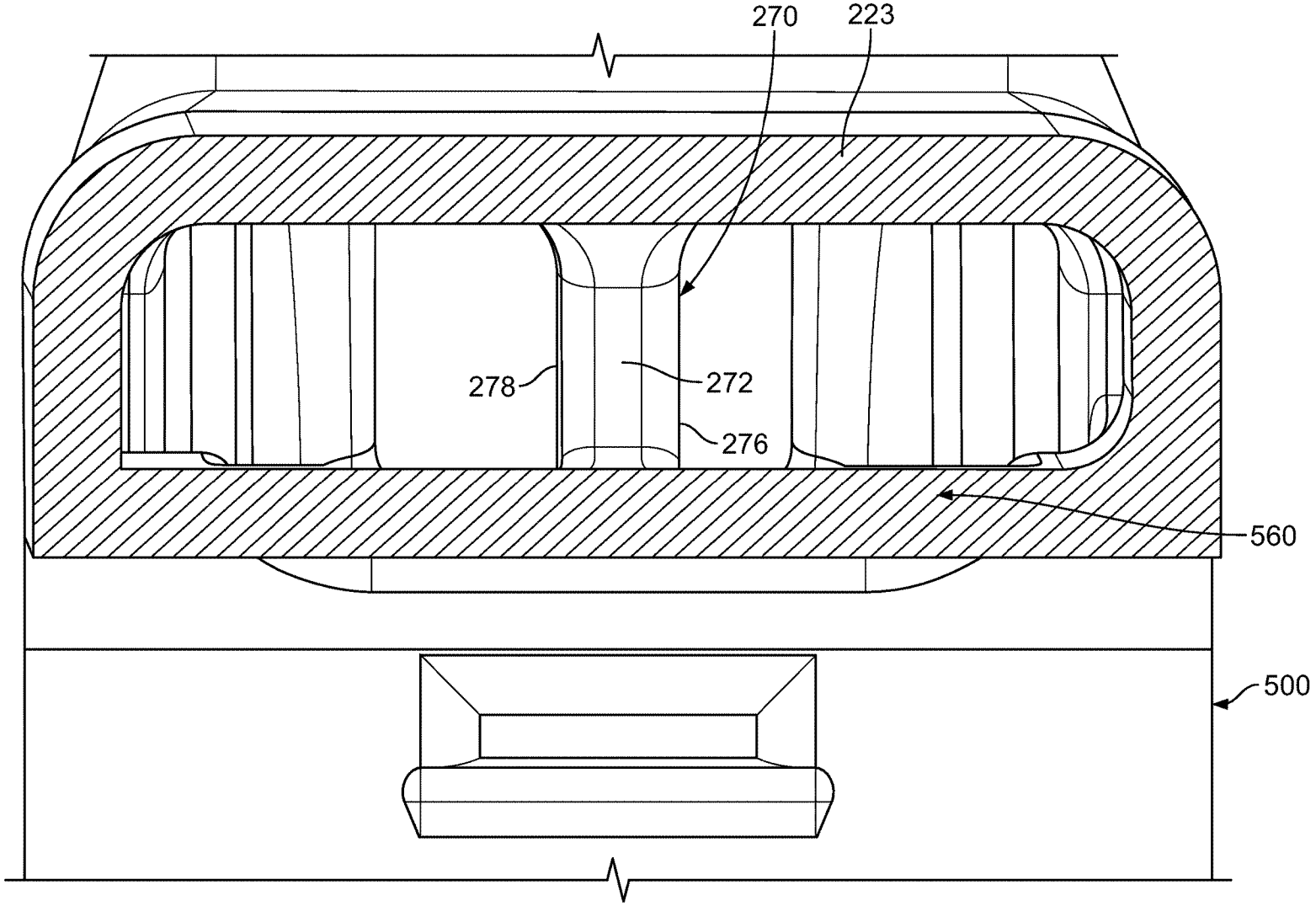
FIG. 16 is an enlarged fragmentary partial cross-sectional view of part of the central portion of the example side frame of FIG. 3, and showing the rear internal top anti-buckling rib of this example side frame of FIG. 3.
Figure 17:
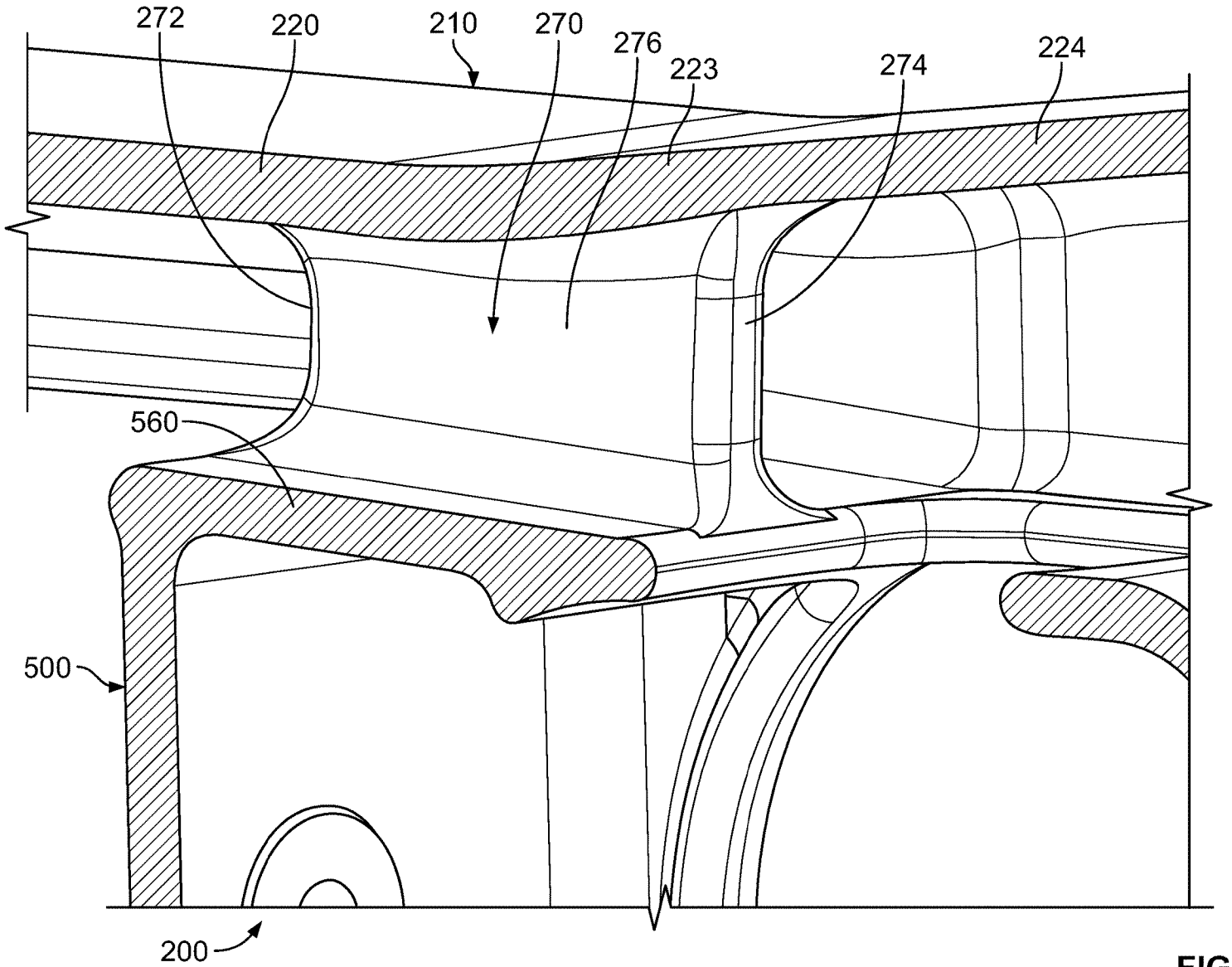
FIG. 17 is an enlarged fragmentary partial cross-sectional perspective view of part of the central portion of the example side frame of FIG. 3, and showing the rear internal top anti-buckling rib of this example side frame of FIG. 3.
Figure 18:
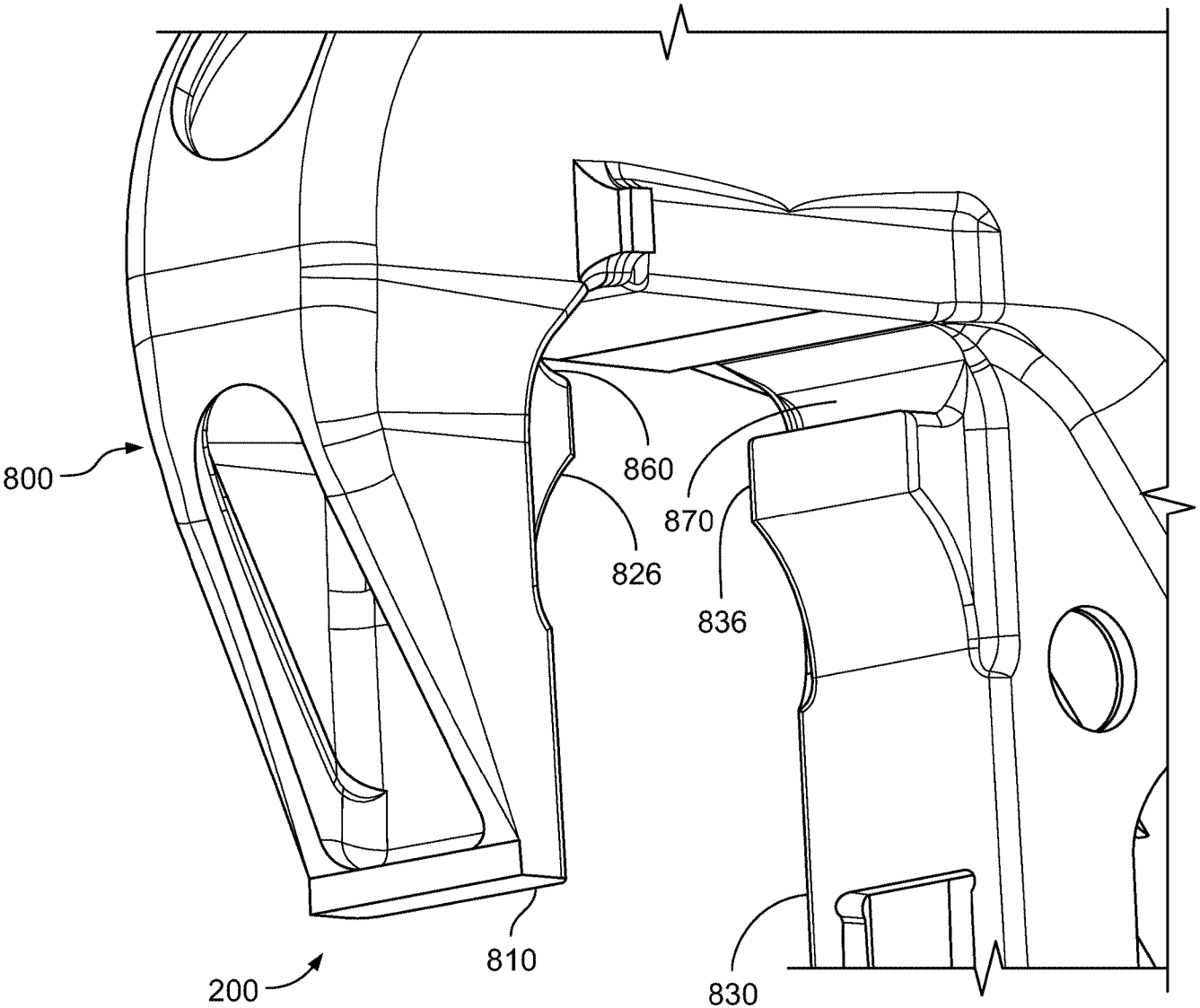
FIG. 18 is an enlarged fragmentary partial cross-sectional perspective view of part of the front portion of the example side frame of FIG. 3, and showing the front pedestal roof of this example side frame of FIG. 3.
Figure 19:
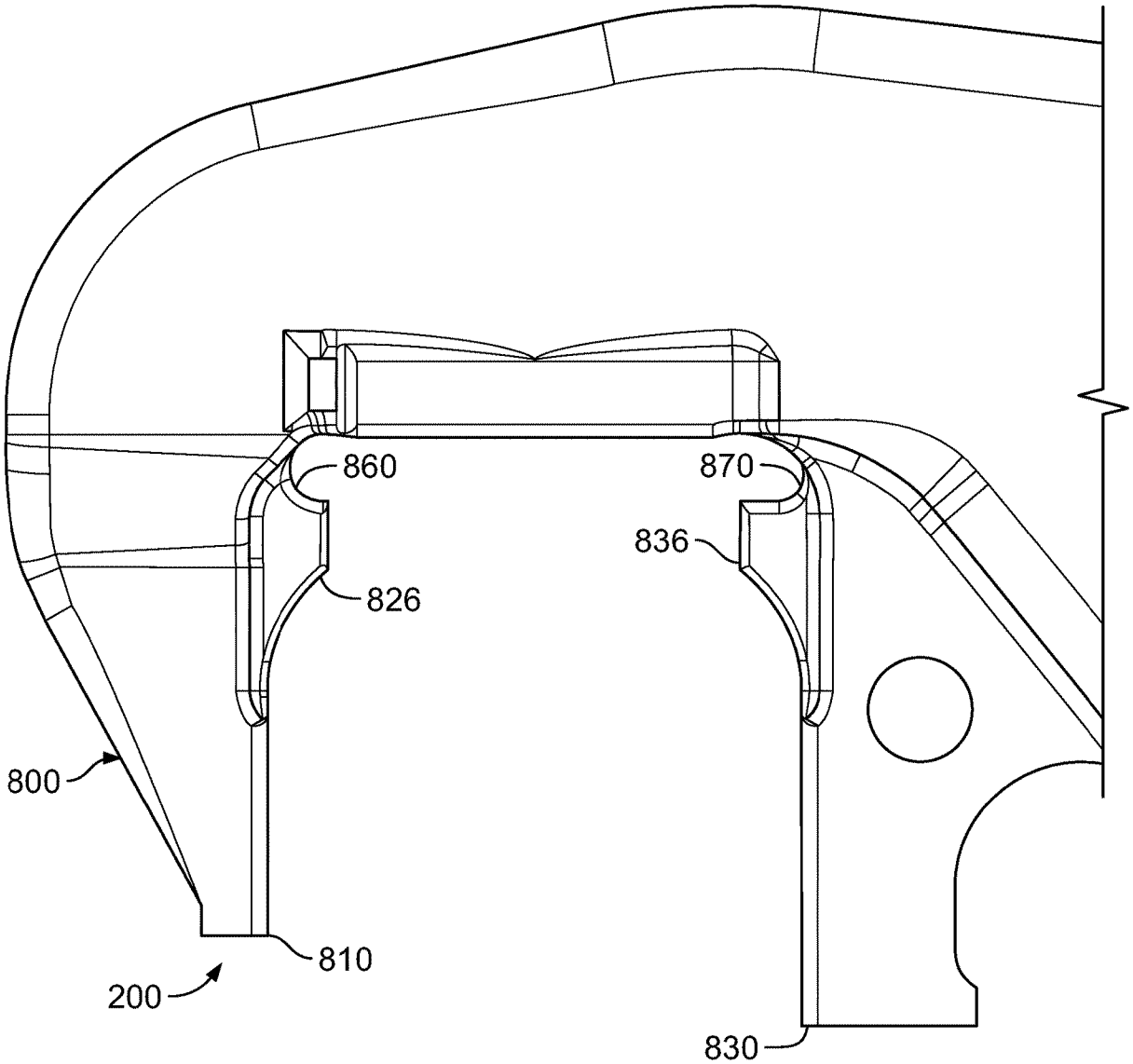
FIG. 19 is an enlarged fragmentary side view of part of the front portion of the example side frame of FIG. 3, and showing the front pedestal roof of this example side frame of FIG. 3.
Figure 24:
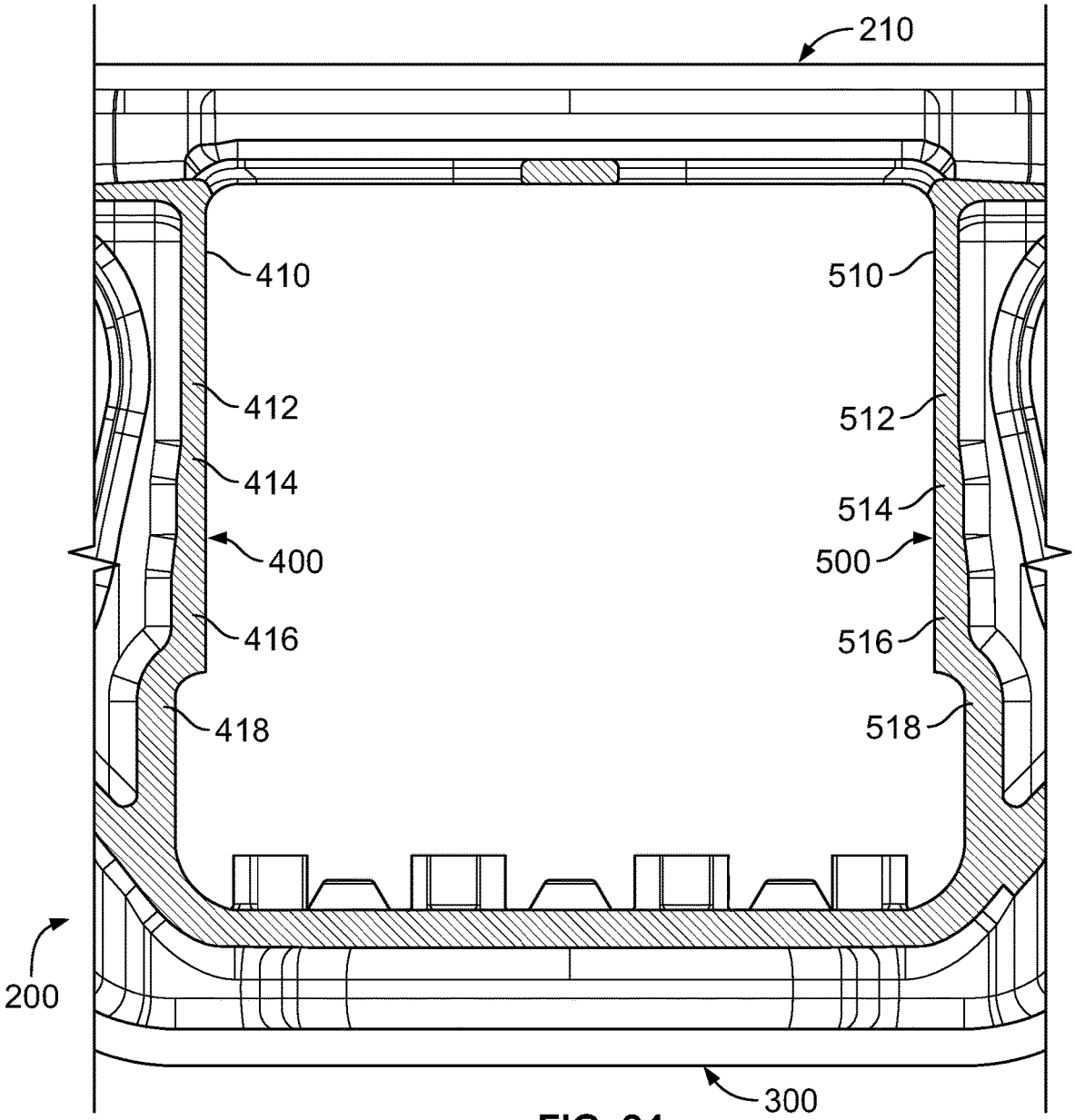
FIG. 24 is an enlarged fragmentary partial cross-sectional view of part of the central portion of the example side frame of FIG. 3, and showing three step transition front and rear columns of the example side frame of FIG. 3.

As best shown in FIGS. 14 and 24, the columns 400 and 500 each have respective upstanding inner wall 410 and 510 each with a three-step transition profile. More specifically, column 400 includes inner wall 410 having: (1) a first area 412 having a first thickness; (2) a second area 414 having a second thickness that is greater than the first thickness; (3) a third area 416 having a third thickness that is greater than the second thickness; (4) a fourth area 418 having a fourth thickness that is greater than the third thickness; (5) a first transition area from the first area 412 to the second area 414; (6) a second transition area from the second area 414 to the third area 416; and (7) a third transition area from the third area 416 to the fourth area 418. In this illustrated example embodiment, the first area 412 has a thickness of approximately 16 millimeters, the second area 414 has a thickness of approximately 19 millimeters, the third area has a thickness of approximately 22 millimeters, and the fourth area has a thickness of approximately 25 millimeters. In this illustrated example embodiment, the first transition area transitions from 16 millimeters to 19 millimeters, the second transition area transitions from 19 millimeters to 22 millimeters, and the third transition area transitions from 22 millimeters to 25 millimeters.

Likewise, column 500 includes inner wall 510 having: (1) a first area 512 having a first thickness; (2) a second area 514 having a second thickness that is greater than the first thickness; (3) a third area 516 having a third thickness that is greater than the second thickness; (4) a fourth area 518 having a fourth thickness that is greater than the third thickness; (5) a first transition area from the first area 512 to the second area 514; (6) a second transition area from the second area 514 to the third area 516; and (7) a third transition area from the third area 516 to the fourth area 518. In this illustrated example embodiment, the first area 512 has a thickness of approximately 16 millimeters, the second area 514 has a thickness of approximately 19 millimeters, the third area has a thickness of approximately 22 millimeters, and the fourth area has a thickness of approximately 25 millimeters. In this illustrated example embodiment, the first transition area transitions from 16 millimeters to 19 millimeters, the second transition area transitions from 19 millimeters to 22 millimeters, and the third transition area transitions from 22 millimeters to 25 millimeters.

This configuration assists in lowering stresses and deflections in the top center member 220, the transition area 221, the transition area 223, the lower ribs 351*a* and 351*b*, and the bottom member 300 of the side frame 200. These lower deflections enable higher loads to be placed on the side frame 200. These lower deflections also enable the side frame 200 to be made with one or more thinner walls and thus lighter to provide a more efficient overall truck. The combination of these improvements substantially reduce, inhibit or minimize potential stress fractures in the side frame 200 by adding supporting specific structures to the side frame 200 and/or by removing stress-concentrating areas to enable the loads to be distributed more evenly across the entire side frame 200.

In various embodiments, the present disclosure provides a railroad car truck including, among other components, a first such improved side frame with all five of these above described improvements or features, a second such improved side frame with all five of these above described improvements or features, and a bolster supported by the improved first side frame and the improved second side frame. In various embodiments, the present disclosure provides a railroad car including one or more such railroad car trucks The combination of these improvements or features substantially reduce, inhibit, or minimize potential stress fractures in the side frame 200 by adding supporting specific structures to the side frame 200 and/or by removing stress-concentrating areas to enable the loads to be distributed more evenly across the entire side frame.

It should be appreciated that the illustrated example embodiment of the side frame 200 employs one example configuration of components and one example size and shape of each of the components. It should be appreciated that other embodiments of the side frame may employ different configurations of the components and/or components of different sizes or shapes in accordance with the present disclosure.

It should also be appreciated from the above description, that each of the above described stress reducing improvements or features described herein on their own reduce the amount of stress placed in certain critical areas on the side frame. In combination, the benefits are further increased. This combination of these five improvements or features provide a new side frame configuration that enables the side frame to pass expected new testing requirements to be imposed by the Association of American Railroads.

It should further be appreciated that the present disclosure contemplates that any one of the above described five stress reducing improvements or features described herein can be individually employed in a side frame without incorporating one or more of the other stress reducing improvements or features in various alternative embodiments of the present disclosure.

It should also be appreciated that the present disclosure contemplates that any three or more but less than all of the above described five stress reducing improvements or features described herein can be employed together in a side frame without incorporating one or more of the other stress reducing improvements or features in various alternative embodiments of the present disclosure.

It should also be appreciated from the above that combinations of these improvements or features enable an overall lighter weight side frame, lighter weight side frame castings to enhance production, and lighter side frame castings to enable the railroad cars to become more efficient. It should thus be appreciated that the present disclosure provides an overall reduction in the weight of the side frame, and thus the railroad car truck and the railroad car. Such reduced weight increase fuel efficiency.

It will be understood that modifications and variations may be effected without departing from the scope of the novel concepts of the present invention, and it is understood that this application is to be limited only by the scope of the claims.

The invention claimed is:

1. A railroad car side frame comprising:

a top member;

a bottom member spaced apart from the top member, the bottom member including a spring seat;

a front column connecting the top member and the bottom member, the front column having an inner wall; and a rear column connecting the top member and the bottom member and spaced apart from the front column, the rear column having an inner wall, wherein the inner wall of the front column and/or the inner wall of the rear column includes:

(1) a first area having a first thickness;

(2) a second area having a second thickness that is greater than the first thickness;

(3) a third area having a third thickness that is greater than the second thickness;

(4) a fourth area having a fourth thickness that is greater than the third thickness;

(5) a first transition area from the first area to the second area;

(6) a second transition area from the second area to the third area; and (7) a third transition area from the third area to the fourth area.

2. The railroad car side frame of claim 1, wherein the inner wall of the front column includes:

(1) a first area having a first thickness;

(2) a second area having a second thickness that is greater than the first thickness;

(3) a third area having a third thickness that is greater than the second thickness;

(4) a fourth area having a fourth thickness that is greater than the third thickness;

(5) a first transition area from the first area to the second area;

(6) a second transition area from the second area to the third area; and (7) a third transition area from the third area to the fourth area.

3. The railroad car side frame of claim 2, wherein the inner wall of the rear column includes:

(1) a first area having a first thickness;

(2) a second area having a second thickness that is greater than the first thickness;

(3) a third area having a third thickness that is greater than the second thickness;

(4) a fourth area having a fourth thickness that is greater than the third thickness;

(5) a first transition area from the first area to the second area;

(6) a second transition area from the second area to the third area; and (7) a third transition area from the third area to the fourth area.

4. The railroad car side frame of claim 1, wherein the inner wall of the rear column includes:

(1) a first area having a first thickness;

(2) a second area having a second thickness that is greater than the first thickness;

(3) a third area having a third thickness that is greater than the second thickness;

(4) a fourth area having a fourth thickness that is greater than the third thickness;

(5) a first transition area from the first area to the second area;

(6) a second transition area from the second area to the third area; and (7) a third transition area from the third area to the fourth area.

5. The railroad car side frame of claim 1, wherein thickness of the inner wall of the front column increases towards the spring seat.

6. The railroad car side frame of claim 5, wherein thickness of the inner wall of the rear column increases towards the spring seat.

7. The railroad car side frame of claim 1, wherein thickness of the inner wall of the rear column increases towards the spring seat.

8. The railroad car side frame of claim 1, wherein the bottom member includes a front turn from the spring seat to the front column that includes a compound radius of curvature, the compound radius of curvature comprising a first radius and a second radius tangential to the first radius, the first radius covering a majority of the front turn and the second radius covering a minority of the front turn, the first radius greater than the second radius; and the bottom member includes a rear turn from the spring seat to the rear column that includes a compound radius of curvature, the compound radius comprising a first radius and a second radius tangential to the first radius, the first radius covering a majority of the rear turn and the second radius covering a minority of the rear turn, the first radius greater than the second radius.

9. The railroad car side frame of claim 1, further comprising:

a front angled tension member connecting the top member and the bottom member;

a rear angled tension member connecting the top member and the bottom member;

a front pedestal connected to the top member and the front angled tension member;

a rear pedestal connected to the top member and the rear angled tension member;

an inner turn from an inner pedestal leg of the front pedestal to a pedestal roof of the front pedestal that includes a compound radius of curvature, the compound radius of curvature comprising a first radius and a second radius tangential to the first radius, the first radius covering a majority of the inner turn and the second radius covering a minority of the inner turn, the first radius greater than the second radius; and an inner turn from an inner pedestal leg of the rear pedestal to the pedestal roof of the rear pedestal that includes a compound radius of curvature, the compound radius of curvature comprising a first radius and a second radius tangential to the first radius, the first radius covering a majority of the inner turn and the second radius covering a minority of the inner turn, the first radius greater than the second radius.

10. The railroad car side frame of claim 1, further comprising:

at least one internal upper sidewall reinforcement pad and at least one internal lower sidewall reinforcement pad; and a front internal top anti-buckling rib extending downwardly from the top member and/or a rear internal top anti-buckling rib extending downwardly from the top member.

11. A railroad car side frame comprising:

a top member;

a bottom member spaced apart from the top member, the bottom member including a spring seat;

a front column connecting the top member and the bottom member, wherein an inner wall of the front column has at least a three-step transition which includes at least three transitional portions, each being narrower at each upper end and wider at each lower end, wherein each of the transitional portions interconnects to adjacent steps having different and substantially uniform thickness such that a thickness of the inner wall only increases towards the spring seat; and a rear column connecting the top member and the bottom member and spaced apart from the front column, wherein an inner wall of the rear column has at least a three-step transition which includes at least three transitional portions, each being narrower at each upper end and wider at each lower end, wherein each of the transitional portions interconnects to adjacent steps having different and substantially uniform thickness such that a thickness of the inner wall only increases towards the spring seat.

12. The railroad car side frame of claim 11, further comprising:

a front angled tension member connecting the top member and the bottom member.

13. The railroad car side frame of claim 11, further comprising:

a rear angled tension member connecting the top member and the bottom member.

14. The railroad car side frame of claim 12, further comprising:

a front pedestal connected to the top member and the front angled tension member.

15. The railroad car side frame of claim 13, further comprising:

a rear pedestal connected to the top member and the rear angled tension member.

16. The railroad car side frame of claim 11, further comprising:

a front internal top anti-buckling rib extending downwardly from the top member.

17. The railroad car side frame of claim 11, further comprising:

a rear internal top anti-buckling rib extending downwardly from the top member.

18. The railroad car side frame of claim 11, further comprising:

at least one internal upper sidewall reinforcement pad and at least one internal lower sidewall reinforcement pad.

19. The railroad car side frame of claim 11, wherein the bottom member includes a front turn from the spring seat to the front column that includes a compound radius of curvature, the compound radius of curvature comprising a first radius and a second radius tangential to the first radius, the first radius covering a majority of the front turn and the second radius covering a minority of the front turn, the first radius greater than the second radius; and the bottom member includes a rear turn from the spring seat to the rear column that includes a compound radius of curvature, the compound radius comprising a first radius and a second radius tangential to the first radius, the first radius covering a majority of the rear turn and the second radius covering a minority of the rear turn, the first radius greater than the second radius.

20. The railroad car side frame of claim 11, further comprising:

a front angled tension member connecting the top member and the bottom member;

a rear angled tension member connecting the top member and the bottom member;

a front pedestal connected to the top member and the front angled tension member;

a rear pedestal connected to the top member and the rear angled tension member;

an inner turn from an inner pedestal leg of the front pedestal to a pedestal roof of the front pedestal that includes a compound radius of curvature, the compound radius of curvature comprising a first radius and a second radius tangential to the first radius, the first radius covering a majority of the inner turn and the second radius covering a minority of the inner turn, the first radius greater than the second radius; and an inner turn from an inner pedestal leg of the rear pedestal to the pedestal roof of the rear pedestal that includes a compound radius of curvature, the compound radius of curvature comprising a first radius and a second radius tangential to the first radius, the first radius covering a majority of the inner turn and the second radius covering a minority of the inner turn, the first radius greater than the second radius.

* * * * *